US008369744B2

(12) United States Patent
Asanuma et al.

(10) Patent No.: US 8,369,744 B2
(45) Date of Patent: Feb. 5, 2013

(54) PROCESS CARTRIDGE INCLUDING A PHOTOSENSITIVE DRUM FOR AN ELECTROPHOTOGRAPHIC IMAGE FORMING APPARATUS

(75) Inventors: Naoya Asanuma, Susono (JP); Masanari Morioka, Numazu (JP); Ryosuke Nakazawa, Suntou-gun (JP); Teruhiko Sasaki, Mishima (JP); Masato Hisano, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/358,811

(22) Filed: Jan. 26, 2012

(65) Prior Publication Data

US 2012/0121290 A1 May 17, 2012

Related U.S. Application Data

(62) Division of application No. 12/488,193, filed on Jun. 19, 2009, now Pat. No. 8,121,517.

(30) Foreign Application Priority Data

Jun. 20, 2008 (JP) ..... 2008-161530

(51) Int. Cl.
*G03G 21/16* (2006.01)

(52) U.S. Cl. ..... 399/111; 399/110; 399/119; 399/167; 399/262

(58) Field of Classification Search ..... 399/110, 399/111, 119, 167, 262
See application file for complete search history.

(56) References Cited

U.S. PATENT DOCUMENTS

| | | | | |
|---|---|---|---|---|
| 4,065,941 | A * | 1/1978 | Aoki | 464/115 |
| 4,439,257 | A | 3/1984 | Sato et al. | |
| 4,829,335 | A | 5/1989 | Kanemitsu et al. | |
| 5,168,319 | A | 12/1992 | Kimura et al. | |
| 5,331,373 | A | 7/1994 | Nomura et al. | |
| 5,452,056 | A | 9/1995 | Nomura et al. | |
| 5,463,446 | A | 10/1995 | Watanabe et al. | |
| 5,583,630 | A | 12/1996 | Kimura et al. | |

(Continued)

FOREIGN PATENT DOCUMENTS

| | | |
|---|---|---|
| CN | 1346077 | 4/2002 |
| EP | 1 178 370 A2 | 2/2002 |

(Continued)

OTHER PUBLICATIONS

PCT International Search Report and Written Opinion of International Search Authority in PCT/JP2009/061673 issued Sep. 2, 2009.

(Continued)

*Primary Examiner* — David Gray
*Assistant Examiner* — Francis Gray
(74) *Attorney, Agent, or Firm* — Fitzpatrick, Cella, Harper & Scinto

(57) ABSTRACT

A process cartridge comprises a photosensitive drum, a developing roller, and a coupling member. The coupling member is capable of inclining relative to the photosensitive drum such that the coupling axis inclines relative to the drum axis. A regulating portion surrounds the coupling member so as to confine the range of inclination of the coupling member. The regulating portion is provided with a recess that recesses in a direction away from the drum axis and away from the developing roller. An angle between the coupling axis and the drum axis is larger when at least a part of the coupling member is in the recess than when the coupling member contacts another portion of the regulating portion.

6 Claims, 27 Drawing Sheets

U.S. PATENT DOCUMENTS 5,585,889 A 12/1996 Shishido et al.
5,640,650 A 6/1997 Watanabe et al.
5,839,028 A 11/1998 Nomura et al.
5,878,309 A 3/1999 Nomura et al.
5,878,310 A 3/1999 Noda et al.
5,903,803 A 5/1999 Kawai et al.
5,920,753 A 7/1999 Sasaki et al.
5,926,666 A 7/1999 Miura et al.
5,943,529 A 8/1999 Miyabe et al.
5,946,531 A 8/1999 Miura et al.
5,950,047 A 9/1999 Miyabe et al.
5,966,567 A 10/1999 Matsuzaki et al.
5,993,101 A 11/1999 Kohno et al.
6,029,031 A 2/2000 Yokomori et al.
6,032,002 A 2/2000 Yokomori et al.
6,061,535 A 5/2000 Yokomori et al.
6,064,843 A 5/2000 Isobe et al.
6,072,968 A 6/2000 Nomura et al.
6,115,569 A 9/2000 Akutsu
6,128,452 A 10/2000 Miyabe et al.
6,137,971 A 10/2000 Sasaki et al.
6,137,973 A 10/2000 Nishiuwatoko et al.
6,141,508 A 10/2000 Sasaki et al.
6,154,623 A 11/2000 Suzuki et al.
6,167,219 A 12/2000 Miyamoto et al.
6,173,140 B1 1/2001 Suzuki et al.
6,175,705 B1 1/2001 Harada et al.
6,178,302 B1 1/2001 Nagashima et al.
6,215,969 B1 4/2001 Nomura et al.
6,249,663 B1 6/2001 Alzawa et al.
6,256,467 B1 7/2001 Yokomori et al.
6,282,390 B1 8/2001 Miyabe et al.
6,301,458 B1 10/2001 Mori et al.
6,317,572 B1 11/2001 Miyabe et al.
6,327,448 B1 12/2001 Sasaki
6,336,017 B1 1/2002 Miyamoto et al.
6,349,191 B1 2/2002 Willis
6,351,620 B1 2/2002 Miyabe et al.
6,366,748 B1 4/2002 Takeuchi et al.
6,385,416 B1 5/2002 Horikawa et al.
6,415,121 B1 7/2002 Suzuki et al.
6,418,296 B1 7/2002 Aizawa et al.
6,473,580 B1 10/2002 Inomata
6,517,439 B1 2/2003 Sears
6,519,431 B1 2/2003 Toba et al.
6,542,706 B2 4/2003 Toba et al.
6,546,220 B1 4/2003 Asakura et al.
6,549,736 B2 4/2003 Miyabe et al.
6,574,446 B2 6/2003 Kitayama
6,603,939 B1 8/2003 Toba et al.
6,608,980 B2 8/2003 Murayama et al.
6,678,488 B2 1/2004 Toba et al.
6,704,522 B2 3/2004 Sasago et al.
6,714,746 B2 3/2004 Morioka et al.
6,714,749 B2 3/2004 Sato et al.
6,714,752 B2 3/2004 Ueno et al.
6,795,666 B2 9/2004 Miyabe et al.
6,823,153 B2 11/2004 Ueno et al.
6,829,455 B2 12/2004 Yasumoto et al.
6,834,175 B2 12/2004 Murayama et al.
6,836,629 B2 12/2004 Miyabe et al.
6,898,391 B2 5/2005 Numagami et al.
6,898,399 B2 5/2005 Morioka et al.
6,901,229 B2 5/2005 Nishiuwatoko et al.
6,912,365 B2 6/2005 Ueno et al.
6,931,226 B2 8/2005 Chadani et al.
6,934,485 B2 8/2005 Miyabe et al.
6,937,832 B2 8/2005 Sato et al.
6,954,600 B2 10/2005 Fujita et al.
6,954,601 B2 10/2005 Numagami et al.
6,963,706 B2 11/2005 Morioka et al.
6,968,146 B1 11/2005 Fujita et al.
6,970,668 B2 11/2005 Ueno et al.
6,978,099 B2 12/2005 Ueno et al.
7,003,247 B2 2/2006 Koishi et al.
7,062,195 B2 6/2006 Kurihara et al.
7,062,200 B2 6/2006 Ueno et al.
7,079,787 B2 7/2006 Ogino et al.
7,092,658 B2 8/2006 Yasumoto et al.
7,121,205 B2 10/2006 Ono et al.
7,127,192 B2 10/2006 Batori et al.
7,136,604 B2 11/2006 Chadani et al.
7,139,502 B2 11/2006 Koishi et al.
7,149,457 B2 12/2006 Miyabe et al.
7,155,141 B2 12/2006 Sato et al.
7,158,736 B2 1/2007 Sato et al.
7,164,875 B2 1/2007 Miyabe et al.
7,174,122 B2 2/2007 Fujita et al.
7,184,690 B2 2/2007 Ueno et al.
7,194,220 B2 3/2007 Sasaki et al.
7,200,349 B2 4/2007 Sato et al.
7,209,682 B2 4/2007 Numagami et al.
7,212,768 B2 5/2007 Numagami et al.
7,224,925 B2 5/2007 Sato et al.
7,248,810 B2 7/2007 Miyabe et al.
7,315,710 B2 1/2008 Ueno et al.
7,349,657 B2 3/2008 Sato et al.
7,366,452 B2 4/2008 Fujita et al.
7,418,225 B2 8/2008 Morioka et al.
7,526,228 B2 4/2009 Shiraki
7,526,278 B2 4/2009 Link et al.
7,529,507 B2 5/2009 Ohashi et al.
7,537,410 B2 5/2009 Parisi et al.
7,603,059 B2 10/2009 Marumoto
7,885,575 B2 * 2/2011 Batori et al. ..... 399/111
2002/0025191 A1 2/2002 Kitayama
2002/0044794 A1 4/2002 Nishiuwatoko et al.
2002/0057928 A1 5/2002 Yasumoto et al.
2003/0059233 A1 3/2003 Jang et al.
2003/0138270 A1 7/2003 Matsuoka
2004/0086300 A1 5/2004 Kawai et al.
2005/0105936 A1 5/2005 Morioka et al.
2005/0191092 A1 9/2005 Toso et al.
2006/0008289 A1 1/2006 Sato et al.
2006/0034637 A1 2/2006 Kim
2006/0051133 A1 3/2006 Koishi et al.
2006/0093398 A1 5/2006 Hayakawa
2006/0182465 A1 8/2006 Funamoto et al.
2006/0228127 A1 10/2006 Miyabe et al.
2006/0240896 A1 10/2006 Ohashi et al.
2006/0269318 A1 11/2006 Ueno et al.
2007/0110478 A1 5/2007 Numagami et al.
2007/0122188 A1 5/2007 Igarashi
2007/0196131 A1 8/2007 Sato
2007/0264048 A1 11/2007 Kuroda
2008/0025757 A1 1/2008 Sato et al.
2008/0152388 A1 * 6/2008 Ueno et al. ..... 399/167
2008/0240796 A1 * 10/2008 Morioka et al. ..... 399/279
2008/0260428 A1 * 10/2008 Ueno et al. ..... 399/167
2009/0196655 A1 8/2009 Takigawa et al.
2009/0317129 A1 * 12/2009 Abe et al. ..... 399/111
2009/0317131 A1 * 12/2009 Morioka et al. ..... 399/117
2009/0317134 A1 * 12/2009 Miyabe et al. ..... 399/119
2010/0054778 A1 * 3/2010 Adachi et al. ..... 399/53
2010/0054823 A1 * 3/2010 Takasaka et al. ..... 399/286
2011/0026967 A1 * 2/2011 Kim et al. ..... 399/111
2011/0091239 A1 * 4/2011 Ueno et al. ..... 399/111
2011/0103812 A1 * 5/2011 Takasaka et al. ..... 399/44
2011/0255900 A1 * 10/2011 Zhou et al. ..... 399/111

FOREIGN PATENT DOCUMENTS

EP 1628165 2/2006
EP 1791034 5/2007
JP 57-153844 9/1982
JP 60-249729 12/1985
JP 61-092967 6/1986
JP 63-4252 1/1988
JP 1-164818 6/1989
JP 4-119363 4/1992
JP 4-240870 8/1992
JP 5-341589 12/1993
JP 8-030168 2/1996
JP 08-328449 12/1996
JP 11-15265 1/1999
JP 11-325097 11/1999
JP 2000-120715 4/2000
JP 2000-137360 5/2000

| | | |
|---|---|---|
| JP | 2002-031153 | 1/2002 |
| JP | 2002-048148 | 2/2002 |
| JP | 2004-045603 | 2/2002 |
| JP | 1199610 | 4/2002 |
| JP | 2002-250435 | 9/2002 |
| JP | 2003-162137 | 6/2003 |
| JP | 2003-202727 | 7/2003 |
| JP | 2004-85593 | 3/2004 |
| JP | 2004-198822 | 7/2004 |
| JP | 3728104 | 10/2005 |
| JP | 2006-072160 | 3/2006 |
| JP | 2006-171785 | 6/2006 |
| JP | 2007-052185 | 3/2007 |
| JP | 2007-218403 | 8/2007 |
| JP | 2007-240007 | 9/2007 |
| JP | 2009-104101 | 5/2009 |
| WO | 2008/072757 | 6/2008 |

OTHER PUBLICATIONS

Office Action in Australian Patent Application No. 2009261109, dated Jul. 1, 2009.
Office Action in Korean Patent Application No. 10-2011-700806, dated May 10, 2012.
Search and Examination Report in Singapore Patent Application No. 201008584-3, mailed Mar. 26, 2012.
International Search Report and Written Opinion of the International Searching Authority dated Dec. 25, 2007, in International Application No. PCT/JP2007/075364.
Singapore Search Report and Written in Singapore Application No. 900903015-6, issued Jan. 5, 2010.
Japanese Office Action dated Mar. 16, 2010, in counterpart Japanese Application No. 2007-330303.
Office Action in Taiwanese Patent Application No. 096149780, mailed Jun. 11, 2012 (with English translation).
Decision on Grant in Russian Patent Application No. 2009128196/28(039172), mailed Apr. 18, 2012 (with English translation).
Notice of Allowance in Korean Patent Application No. 10-2009-7022510, mailed May 3, 2012.
Notice of Acceptance in Australian Patent Application No. 200739163, dated Feb. 3, 2012.
Official Communication in Canadian Patent Application No. 2,670,502, dated Nov. 10, 2011.
Office Action in Japanese Patent Application No. 2007-330304, dated Nov. 22, 2011, with English translation.
Office Action in Indonesia Patent Application No. W-002000901748, dated Mar. 30, 2011 (with partial translation).
Official Communication in Korean Patent Application No. 10-2009-7022510, issued Aug. 8, 2011.
English Translation of Jan. 17, 2011 Office Action in Korean Patent Application No. 10-2009-7015430.
Office Action in Korean Patent Application No. 10-2009-7015474, dated Jan. 17, 2011, with English translation.
Office Action in Korean Patent Application No. 10-2009-7022191, dated Feb. 17, 2011.
English translation of Japanese Laid-open Patent Application Hei No. 1-164818, dated Aug. 29, 2012.
Office Action in Chinese Patent Application No. 207780047584.6, dated Nov. 1, 2010, with English translation.
Office Action in Korean Patent Application No. 10-2009-7015430, dated Jan. 17, 2011.
Australian Search Report and Written Opinion, dated Nov. 24, 2009, which was enclosed with an Invitation to Respond to Written Opinion dated Dec. 22, 2009, in Singapore Application No. 200903732-6.
English-language translation of Japanese Patent Document No. 11-15265 A, dated Aug. 29, 2012.
English-language translation of Japanese Patent Document No. 2003-202727 A, dated Aug. 29, 2012.
International Search Report and Written Opinion in PCT/JP2008/056259,dated Jun. 16, 2008.
Singapore Search Report and Written Opinion in Singapore Application No. 200903005-7, issued Jan. 5, 2010.
International Search Report and Written Opinion of the International Searching Authority dated Apr. 11, 2008, in International Application No. PCT/JP2007/075366.
Office Action in Russian Patent Application No. 2009128196, dated Nov. 3, 2010, with English translation.
Singapore Search Report and Written Opinion in Singapore Application No. 200903015-6, issued Jan. 5, 2010.
Notice of Allowance in Korean Patent Application No. 10-2009-7015430, mailed Aug. 6, 2012.
Official Communication in European Patent Application No. 07 860 559.9, mailed Jul. 17, 2012.

* cited by examiner (a)

(b)

(a)

(b)

(c)

(a)

(b)

(c)

PROCESS CARTRIDGE INCLUDING A PHOTOSENSITIVE DRUM FOR AN ELECTROPHOTOGRAPHIC IMAGE FORMING APPARATUS

This is a divisional of co-pending U.S. patent application Ser. No. 12/488,193, filed Jun. 19, 2009.

FIELD OF THE INVENTION AND RELATED ART

The present invention relates to a process cartridge, an electrophotographic image forming apparatus to which the process cartridge is detachably mountable, and an electrophotographic photosensitive drum unit.

The electrophotographic image forming apparatus includes an electrophotographic copying machine and an electrophotographic printer (laser beam printer, LED printer, and so on).

The process cartridge contains, as a unit, an electrophotographic photosensitive member and process means actable on said electrophotographic photosensitive member, and is detachably mountable to a main assembly of the electrophotographic image forming apparatus. For example, the process cartridge contains an electrophotographic photosensitive member and at least one of developing means, charging means and cleaning means which are the process means, as a unit. Therefore, an example of the process cartridge comprises an electrophotographic photosensitive member and developing means, charging means and cleaning means which are the process means, as a unit. Another example of the process cartridge comprises an electrophotographic photosensitive member and charging means as the process means, as a unit. A further example of the process cartridge comprises an electrophotographic photosensitive member and charging means and cleaning means as the process means, as a unit. An even further example of the process cartridges comprises an electrophotographic photosensitive member and developing means as the process means, as a unit.

The apparatus main assembly of the electrophotographic image forming apparatus is parts of the electrophotographic image forming apparatus except the process cartridge.

The process cartridge can be mounted to and dismounted from the main assembly of the apparatus. Therefore, the maintenance operation of the apparatus can be carried out in effect by the user without relying on the service person. This improves the maintenance operativity of the image forming apparatus.

In the field of the process cartridge, in order to receive the rotational driving force for rotating the drum-shaped electrophotographic photosensitive member (drum) from the main assembly, following structure is known.

The main assembly of the apparatus includes a rotatable member for transmitting a driving force of a motor and includes a twisted hole which is provided at a center of said rotatable member and which has a non-circular cross-section having a plurality of corner portions. The process cartridge includes a twisted projection which has a non-circular cross-section having a plurality of corner portions and which is provided on one longitudinal end of the drum, the twisted projection being engageable with the twisted hole of the rotatable member. After the process cartridge is mounted to the main assembly when the rotatable member rotates in the state that the projection is in engagement with the hole, the rotational force is transmitted from the rotatable member to the drum, while the projection receives the retracting force in the direction toward the hole. By this, the rotational force for rotating the drum is transmitted from the main assembly to the photosensitive drum (Japanese Patent No. 2875203).

In another known system, a gear fixed to the drum of the process cartridge is engaged with a driving gear of the main assembly to rotate the drum (Japanese Patent 1604488).

The present invention further develops the prior art described above.

SUMMARY OF THE INVENTION

It is a principal object of the present invention to provide a process cartridge which is mountable to the main assembly which is not provided with the mechanism for moving the main assembly side coupling member for transmitting the rotational force to the drum, by the opening and closing operation of the main assembly cover in the axial direction, the process cartridge being capable of rotating the drum smoothly.

It is another object of the present invention to provide an electrophotographic photosensitive drum unit usable with the process cartridge and the electrophotographic image forming apparatus relative to which the process cartridge is mountable and dismountable.

It is a further object of the present invention to provide a process cartridge which is dismountable in a direction perpendicular to an axis of a driving shaft from the main assembly provided with the driving shaft.

It is a further object of the present invention to provide an electrophotographic photosensitive drum unit usable with such the process cartridge and an electrophotographic image forming apparatus to which such a process cartridge is detachably mountable.

It is a further object of the present invention to provide a process cartridge mounted to the main assembly provided with a driving shaft in a direction substantially perpendicular to an axis of the driving shaft.

It is a further object of the present invention to provide an electrophotographic photosensitive drum unit usable with the process cartridge and an electrophotographic image forming apparatus to which such a process cartridge is detachably mountable.

It is a further object of the present invention to provide a process cartridge mountable and dismountable in a direction substantially perpendicular to an axis of the driving shaft relative to the main assembly provided with the driving shaft.

It is a further object of the present invention to provide an electrophotographic photosensitive drum unit usable with such the process cartridge and an electrophotographic image forming apparatus to which such a process cartridge is detachably mountable.

It is a further object of the present invention to provide a process cartridge in which the rotational accuracy of the electrophotographic photosensitive drum is improved as compared with the in the case where the engagement between gears is used for the transmission of a rotational force to the process cartridge from a main assembly.

It is a further object of the present invention to provide an electrophotographic photosensitive drum unit usable with the process cartridge and an electrophotographic image forming apparatus on which the process cartridge is detachably mountable.

It is a further object of the present invention to provide a process cartridge which has a regulating portion for regulating the inclination angle of the coupling member so that the angle at which the coupling member inclines by the weight is smaller than the angle in the case where the coupling member is in the pre-engagement angular position.

It is a further object of the present invention to provide an electrophotographic photosensitive drum unit usable with the process cartridge and the electrophotographic image forming apparatus on which the process cartridge is detachably mountable.

It is a further object of the present invention to provide a process cartridge in which before mounting the cartridge to a main assembly, the coupling is prevented from inclining greatly in the unnecessary direction, by which the cartridge can be smoothly mounted to the main assembly.

It is a further object of the present invention to provide an electrophotographic photosensitive drum unit usable for such a process cartridge and an electrophotographic image forming apparatus to which such a process cartridge is detachably mountable.

It is a further object of the present invention to provide a process cartridge which is mounted and dismounted in the direction substantially perpendicular to an axis of the driving shaft provided in a main assembly, and the electrophotographic photosensitive drum provided therein is rotated smoothly.

It is a further object of the present invention to provide a the electrophotographic photosensitive drum unit usable for such a process cartridge and an electrophotographic image forming apparatus to which such a process cartridge is detachably mountable.

According to an aspect of the present invention, there is provided a process cartridge which is detachably mountable to a main assembly of an electrophotographic image forming apparatus including a driving shaft having a rotational force applying portion by moving in a direction substantially perpendicular to an axis of said driving shaft, said process cartridge comprising:

i) an electrophotographic photosensitive drum rotatable about an axis and having a photosensitive layer at its peripheral surface;

ii) process means actable on said electrophotographic photosensitive drum;

iii) a coupling member engageable with said rotational force applying portion to receive a rotational force for rotating said electrophotographic photosensitive drum, said coupling member being capable of taking a rotational force transmitting angular position for transmitting the rotational force for rotating said electrophotographic photosensitive drum to said electrophotographic photosensitive drum, a pre-engagement angular position in which said coupling member is inclined away from the axis of said electrophotographic photosensitive drum from said rotational force transmitting angular position and a disengaging angular position in which said coupling member is inclined away from the axis of said electrophotographic photosensitive drum from said rotational force transmitting angular position; and iv) a regulating portion for regulating an inclination angle of said coupling member such that downward inclination angle of said coupling member is smaller than an inclination angle of said coupling member when said coupling member is at the pre-engagement angular position, wherein in mounting said process cartridge to the main assembly of the apparatus by moving said process cartridge in a direction substantially perpendicular to the axis of said electrophotographic photosensitive drum, said coupling member moves from the pre-engagement angular position to the rotational force transmitting angular position to oppose the driving shaft, and in dismounting said process cartridge from the main assembly of the apparatus by moving said process cartridge in the direction substantially perpendicular to the axis of said electrophotographic photosensitive drum, said coupling member moves from the rotational force transmitting angular position to the disengaging angular position to disengage from the driving shaft According to another aspect of the present invention, there is provided an electrophotographic image forming apparatus to which a process cartridge is detachably mountable to a main assembly of the apparatus, said electrophotographic image forming apparatus comprising:

i) a driving shaft having a rotating force applying portion; and ii) a process cartridge including, an electrophotographic photosensitive drum rotatable about an axis and having a photosensitive layer at its peripheral surface;

process means actable on said electrophotographic photosensitive drum;

a coupling member engageable with said rotational force applying portion to receive a rotational force for rotating said electrophotographic photosensitive drum, said coupling member being capable of taking a rotational force transmitting angular position for transmitting the rotational force for rotating said electrophotographic photosensitive drum to said electrophotographic photosensitive drum, a pre-engagement angular position in which said coupling member is inclined away from the axis of said electrophotographic photosensitive drum from said rotational force transmitting angular position and a disengaging angular position in which said coupling member is inclined away from the axis of said electrophotographic photosensitive drum from said rotational force transmitting angular position; and a regulating portion for regulating an inclination angle of said coupling member such that downward inclination angle of said coupling member is smaller than an inclination angle of said coupling member when said coupling member is at the pre-engagement angular position;

wherein in mounting said process cartridge to the main assembly of the apparatus by moving said process cartridge in a direction substantially perpendicular to the axis of said electrophotographic photosensitive drum, said coupling member moves from the pre-engagement angular position to the rotational force transmitting angular position to oppose the driving shaft, and in dismounting said process cartridge from the main assembly of the apparatus by moving said process cartridge in the direction substantially perpendicular to the axis of said electrophotographic photosensitive drum, said coupling member moves from the rotational force transmitting angular position to the disengaging angular position to disengage from the driving shaft.

According to a further aspect of the present invention, there is provided a electrophotographic photosensitive drum unit which is detachably mountable to a main assembly of an electrophotographic image forming apparatus including a driving shaft having a rotational force applying portion by moving in a direction substantially perpendicular to an axis of said driving shaft, said process cartridge comprising:

i) an electrophotographic photosensitive drum rotatable about an axis and having a photosensitive layer at its peripheral surface;

ii) a coupling member engageable with said rotational force applying portion to receive a rotational force for rotating said electrophotographic photosensitive drum, said coupling member being capable of taking a rotational force transmitting angular position for transmitting the rotational force for rotating said electrophotographic photosensitive drum to said electrophotographic photosensitive drum, a pre-engagement angular position in which said coupling member is inclined away from the axis of said electrophotographic photosensitive drum from said rotational force transmitting angular position and a disengaging angular position in which said coupling member is inclined away from the axis of said electrophotographic photosensitive drum from said rotational force transmitting angular position;

iii) a regulating portion for regulating an inclination angle of said coupling member such that downward inclination angle of said coupling member is smaller than an inclination angle of said coupling member when said coupling member is at the pre-engagement angular position;

wherein in mounting said process cartridge to the main assembly of the apparatus by moving said process cartridge in a direction substantially perpendicular to the axis of said electrophotographic photosensitive drum, said coupling member moves from the pre-engagement angular position to the rotational force transmitting angular position to oppose the driving shaft, and in dismounting said process cartridge from the main assembly of the apparatus by moving said process cartridge in the direction substantially perpendicular to the axis of said electrophotographic photosensitive drum, said coupling member moves from the rotational force transmitting angular position to the disengaging angular position to disengage from the driving shaft.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiments (General Arrangement)

Referring to the accompanying drawings, the preferred embodiments of the present invention will be described.

Figure 1:
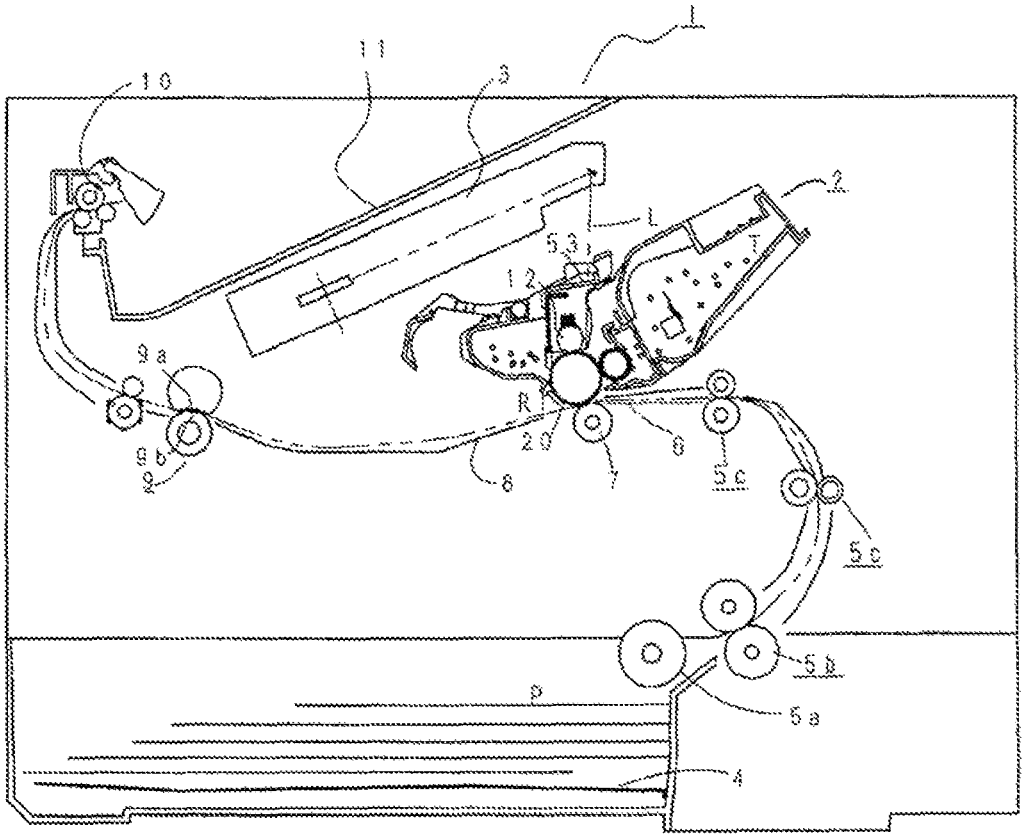
FIG. 1 is a sectional view of a main assembly of an image forming apparatus and a cartridge according to an embodiment of the present invention.
Figure 2:
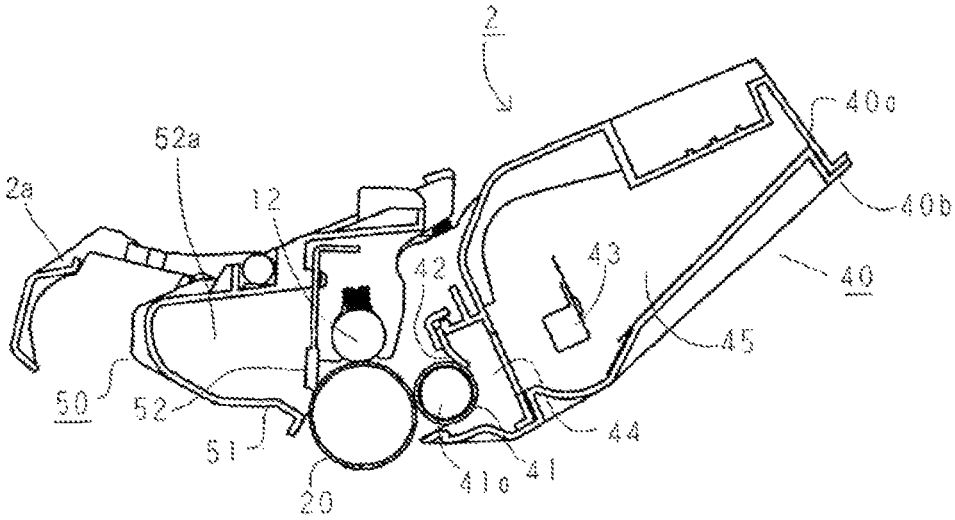
FIG. 2 is an enlarged sectional view of the cartridge.

FIG. 1 is a sectional views of a main assembly 1 (main assembly) and a process cartridge 2 (cartridge) of an electrophotographic image forming apparatus according to the present embodiment. FIG. 2 is an enlarged cross-sectional view of the cartridge 2. Referring to FIGS. 1-2, a general arrangement and an image formation process of the image forming apparatus according to the present embodiment will be described.

The present invention is applied to the process cartridge itself shown in FIG. 2, for example. In addition, the present invention is applied to the photosensitive drum unit 21 itself shown in FIG. 17 (*a*), for example. In addition, the present invention is applied to the electrophotographic image forming apparatus itself shown in FIG. 1, for example.

This image forming apparatus is an electrophotographic laser beam printer with which the cartridge 2 is detachably mountable to the main assembly 1. When the cartridge 2 is mounted to the main assembly 1, there is an exposure device (laser scanner unit) 3 above the cartridge 2. A sheet tray 4 which contains a recording material (sheet material) P which is an image formation object is provided, below of the cartridge 2. In addition, in the main assembly 1, along the feeding direction of the sheet material P, there are provided a pickup roller 5*a*, a feeding roller 5*b*, a feeding roller pair 5*c*, a transfer guide 6, a transfer charging roller 7, a conveyance guide 8, a fixing device 9, a discharging roller pair 10, a discharging tray 11, and so on.

Designated by 2*a* is a drum shutter, and when the cartridge 2 is taken out of the main assembly 1, it protects a photosensitive drum 20. The shutter 2*a* is in an open position in FIG. 1 and FIG. 2.

(Image Formation Process)

The outline of the image formation process will be described. The electrophotographic photosensitive drum (drum) 20 is rotated in a direction indicated by the arrow R1 at a predetermined peripheral speed (process speed) on the basis of the print start signal. The drum 20 is rotatable about the axis (drum axis) L1, and has a photosensitive layer as the outermost layer. A charging roller (charging means) 12 which is supplied with a bias voltage contacts to an outer surface of the drum 20, and the outer surface of the drum 20 is uniformly charged by this charging roller 12.

A laser beam L modulated correspondingly to a serial electrical digital pixel signal of the image information is outputted from the exposure device 3. The laser beam L enters an inside of the cartridge 2 through an exposure window 53 of the upper portion of the cartridge 2 to expose the outer surface of the drum 20 scanningly to the laser beam. By this, an electrostatic latent image corresponding to the image information is formed on the outer surface of the drum 20. The electrostatic latent image is visualized into a toner image with the developer T (toner) in the developing device unit 40.

The charging roller 12 is contacted to the drum 20 and charges the drum 20 electrically. The charging roller 12 is rotated by the drum 20. The developing device unit 40 supplies the toner to the developing area of the drum 20 to develop the latent image formed on the drum 20.

The developing device unit 40 feeds the toner T out of a toner chamber 45 into a toner feed chamber 44 by the rotation of a stirring member 43. While it rotates a developing roller 41 which is a developer carrying member which contains a magnet roller (stationary magnet) 41*a*, it forms a layer of the toner triboelectrically charged by a developing blade 42 on the surface of the developing roller (developing means) 41. It forms the toner image by transferring the toner to the drum 20 in accordance with the latent image to visualize the latent image. While the developing blade 42 regulates the toner amount on the peripheral surface of the developing roller 41, it triboelectrically charges the toner.

On the other hand, the sheet material P contained in a lower part of the main assembly 1 is fed from the sheet tray 4 by the pickup roller 5*a*, the feeding roller 5*b*, and feeding roller 5*c* in timed relation with the output of the laser beam L. The sheet material P is supplied via the transfer guide 6, in the timed relation, to a transfer position formed between the drum 20 and the charging roller for the transferring 7. In the transfer position, the toner image is transferred onto the sheet material P sequentially from the drum 20.

The sheet material P onto which the toner image has been transferred is separated from the drum 20, and is fed to a fixing device 9 along a conveyance guide 8. The sheet material P passes a nip formed between a fixing roller 9*a* and a pressing roller 9*b* which constitute the fixing device 9. It is subjected to the pressing and heat-fixing process in the nip, so that the toner image is fixed on the sheet material P. The sheet material P which has the fixed toner image is fed to a discharging roller pair 10, and is discharged to the discharging tray 11.

On the other hand, as for the drum 20 after the image transfer, the residual toner on the outer surface thereof is removed by a cleaning blade (cleaning means) 52, and it is used for the image formation operation which starts with the charging. The residual toner removed from the drum 20 is stored in the waste toner chamber 52*a* of the photosensitive member unit 50.

In the above described example, the charging roller 12, the developing roller 41, the cleaning blade 52, and so on are the process means actable on the drum 20.

(Frame Structure of the Process Cartridge)

Figure 3:
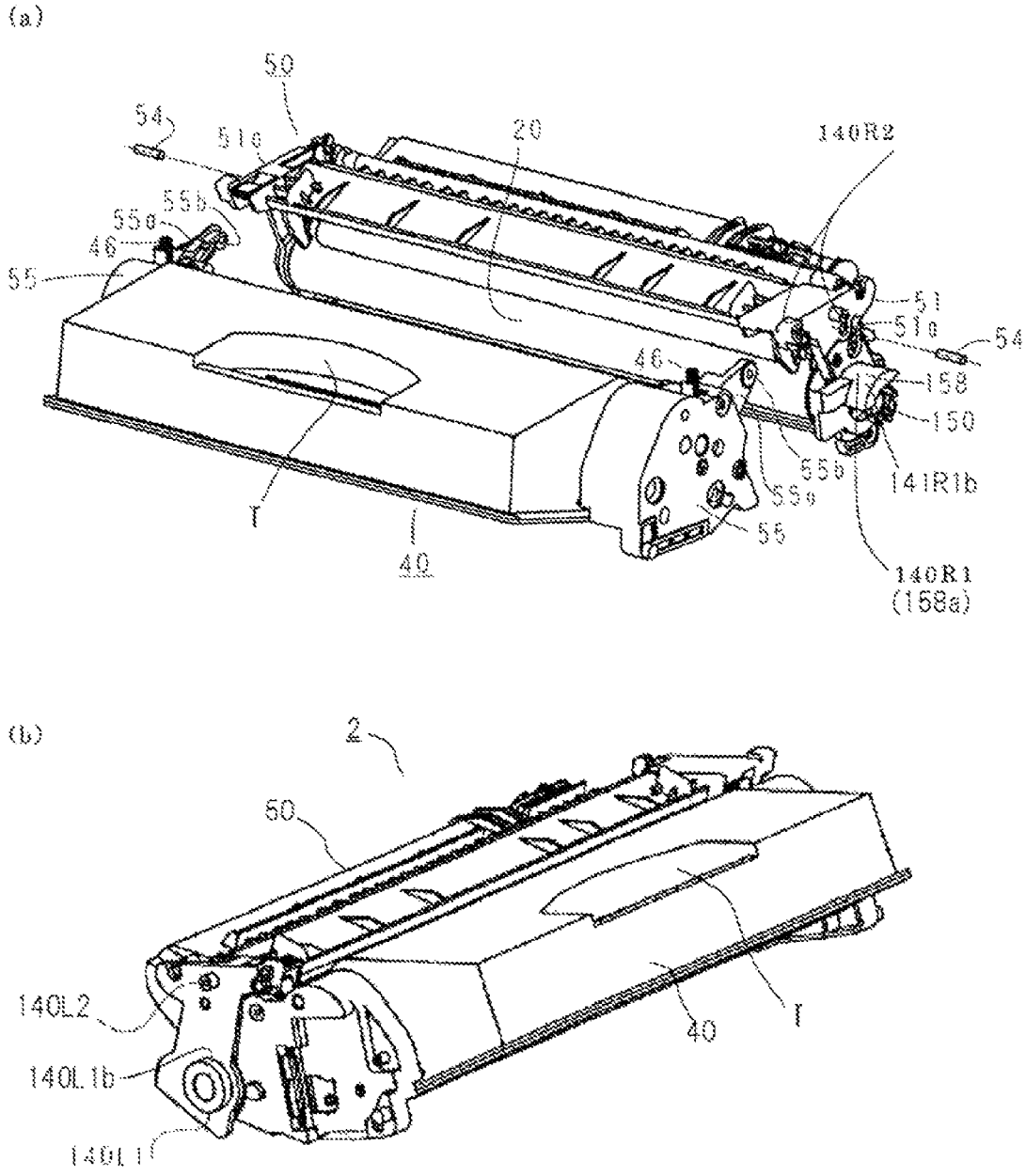
FIG. 3 is a perspective view illustrating a structure of a frame of the cartridge.

FIG. 3 is a perspective view illustrating a frame structure of the cartridge 2. Referring to FIG. 2 and FIG. 3, the frame structure of the cartridge 2 will be described.

As shown in FIG. 2, the drum 20, the charging roller 12, and the cleaning blade 52 are mounted to a drum frame 51 to constitute an integral photosensitive member unit 50.

On the other hand, a developing device unit 40 is constituted by a toner chamber 45 which contains the toner, and a toner accommodating chamber 40*a* and cover 40*b* which forms a toner feed chamber 44. The toner accommodating chamber 40*a* and cover 40*b* are connected integrally with each other by the means such as welding.

The photosensitive member unit 50 and the developing device unit 40 are rotatably connected relative to each other by a connection member 54 of the round pin.

That is, on a free end of an arm portion 55*a* formed on a side cover 55 provided at each end with respect to the longitudinal direction (an axial direction of the developing roller 41) of developing device unit 40 a round rotation hole 55*b* is provided in parallel with the developing roller 41. The arm portion 55*a* is inserted into the predetermined position of the drum frame 51. The drum frame 51 is provided with an engaging hole 51*a* (in (a) of FIG. 3, left-hand side is unshown of FIG. 3) for receiving a connection member 54 co-axial with rotation hole 55*b*. The connection member 54 penetrates the rotation hole 55*b* and the engaging hole 51*a*, by which, the photosensitive member unit 50 and the developing device unit 40 are connected with each other rotatably about the connection member 54. At this time, the compression coil spring 46 mounted to the base portion of the arm portion 55*a* abuts to the drum frame 51 to urge the developing device unit 40 downwardly. By this, the developing roller 41 (FIG. 2) is assuredly forced toward the drum 20 direction. A spacing member (unshown) is mounted to each end of the developing roller 41 to hold the developing roller 41 with a predetermined interval from the drum 20.

(Method for Rotational Force Transmission Process Cartridge)

Figure 4:
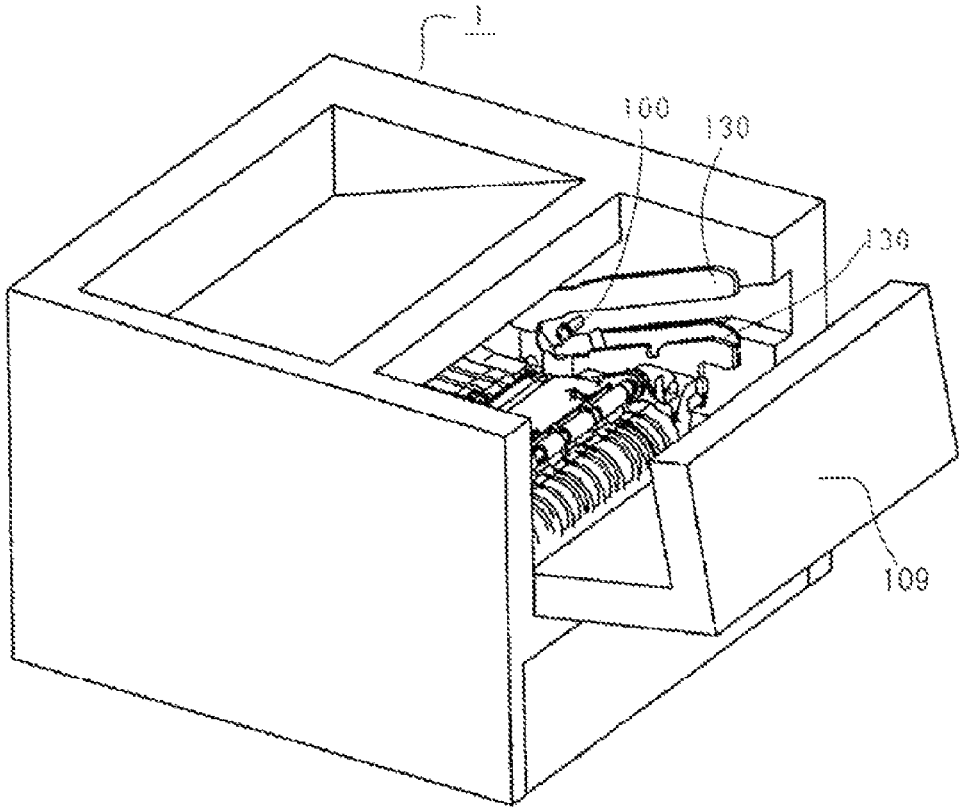
FIG. 4 is a schematic perspective view of the main assembly of the apparatus.

FIG. 4 is a perspective view of the main assembly 1 with the open cartridge door (main assembly cover) 109. The cartridge 2 is not mounted. Referring to FIG. 4, a rotational force transmission method to the cartridge 2 will be described.

The main assembly 1 is provided with a guiding rail 130 for the cartridge mounting and demounting, and the cartridge 2 is mounted to the inside of the main assembly 1 along the guiding rail 130. In this case, a driving shaft 100 of the main assembly 1 and a coupling member 150 (FIG. 3, coupling) as a rotational force transmitting portion of the cartridge 2 are coupled with each other in interrelation with the mounting operation of the cartridge 2. By this, the drum 20 receives the rotational force from the main assembly 1 to rotate.

The coupling member 150 is, as will be described hereinafter, provided to the end of the drum 20, and it is pivotable in substantially all directions relative to the axis L1 of the drum. And, the coupling member 150 of this drum 20 can take a rotational force transmitting angular position (first angular position) for transmitting a rotational force to the drum 20. In addition, it can take a pre-engagement angular position (second angular position) inclined in the direction away from the axis L1 of the drum 20 from the rotational force transmitting angular position. In addition, it can take a disengaging angular position (third angular position) inclined in the direction away from the axis L1 of the drum from the rotational force transmitting angular position. This will be described hereinafter.

Figure 5:
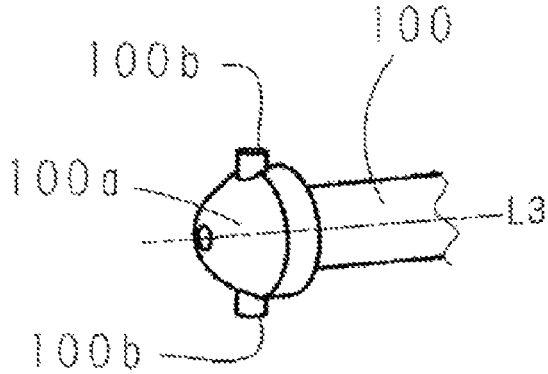
FIG. 5 is a schematic perspective view of a driving shaft of the main assembly of the apparatus.

1) The driving shaft 100 FIG. 5 is a perspective view of the driving shaft 100 provided in the main assembly 1. The driving shaft 100 is coupled with drive transmission means, such as the unshown gear train provided in the main assembly 1, and with the motor. A free end portion 100*a* of the driving shaft 100 has a substantially semispherical surface, and has a rotational force transmitting pins 100*b* as the rotational force applying portion. These configurations will be described hereinafter.

Figure 6:
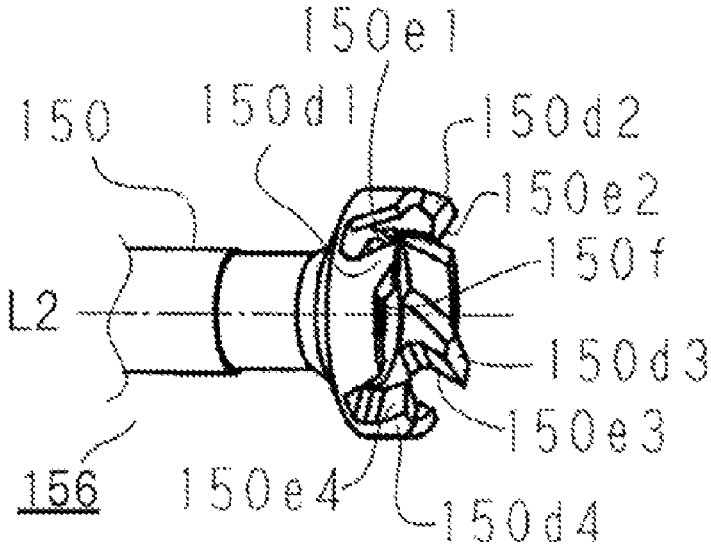
FIG. 6 is a schematic perspective view of the coupling member.

2) Coupling member 150 FIG. 6 is a perspective view of the coupling member 150. The material of the coupling member 150 is polyacetal, polycarbonate, and PPS or the like resin material. In order to enhance the rigidity of the coupling member 150, glass fibers, carbon fibers, and so on may be mixed in the resin material correspondingly to the load torque. When these materials are mixed, the rigidity of the coupling member 150 can be enhanced. In addition, in order to further raise the rigidity, the metal may be inserted in the resin material, and the whole coupling may be made with the metal and so on The free end of the coupling member 150 is provided with a plurality of drive receiving projections 150*d* (150*d*1-150*d*4). The drive receiving projection 150*d* (150*d*1-150*d*4) is provided with a rotational force receiving portion 150*e* (150*e*1-150*e*4), and this is provided inclinedly relative to the axis L2 of the coupling member 150. Furthermore, the inside of drive receiving projections 150*d*1-150*d*4 provides a funnel-like driving shaft receiving surface (recess) 150*f*. The driving shaft receiving surface 150*f* is in the form of a recess.

More particularly, the rotational force receiving portions 150*e* of the coupling member 150 are opposed to each other and disposed interposing the center on a phantom circle C (FIG. 9) which has Center O on the rotation axis of the coupling member 150 (axis L2). In the present embodiment, four rotational force receiving portions 150*e*1-150*e*4 are provided. The driving shaft receiving surface 150*f* crosses with the rotation axis of the coupling member 150, and has an expanded part which expanded toward the free end. The rotational force receiving portions 150*e* (150*e*1-150*e*4) are disposed at equal intervals along the circumferential direction of the rotation of the coupling member 150 at the free end portion of the expanded part.

Figure 7:
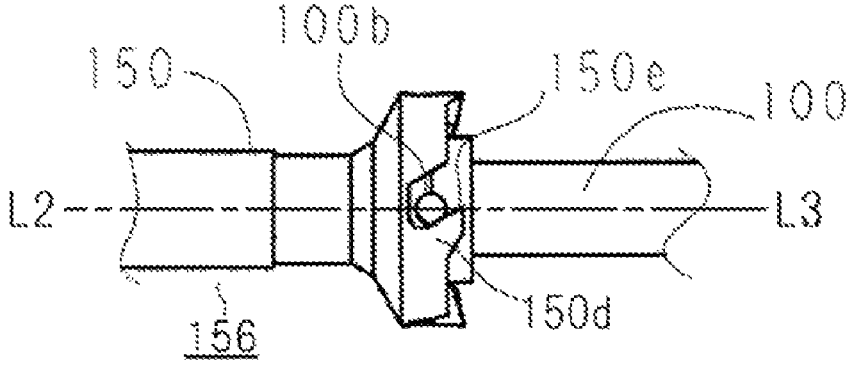
FIG. 7 is an illustration showing the state in which the coupling member and the driving shaft are engaged with each other.
Figure 8:
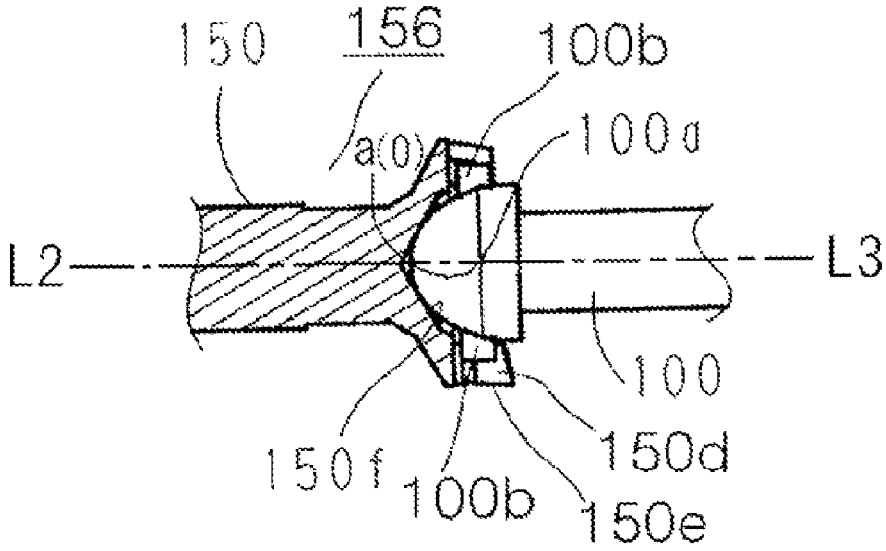
FIG. 8 is a sectional view showing the state in which the coupling member and the driving shaft are engaged with each other.

3) Connection between driving shaft 100 and the coupling member 150 FIG. 7 illustrates the state that the coupling member 150 and the driving shaft 100 connect with each other. FIG. 8 is the sectional view illustrating the state that the coupling member 150 and the driving shaft 100 connect with each other. Referring to FIG. 7 and FIG. 8, the coupling of the driving shaft 100 and the coupling member 150 will be described.

The rotational force transmitting pins 100*b* of the driving shaft 100 are in engagement with the rotational force receiving portions 150*e* (150*e*1-150*e*4). Although it is not shown in FIG. 7, the rotational force transmitting pin 100*b* on the back side also is in engagement with the rotational force receiving portion 150*e*. In addition, the free end portion 100*a* of the driving shaft 100 is in contact with the driving shaft receiving surface 150*f* of the coupling member 150. By the rotation of the driving shaft 100, the rotational force is transmitted to the rotational force receiving portion 150*e* from the rotational force transmitting pin 100*b*. In addition, rotational force receiving portion 150*e* is inclined relative to the axis L2 of the coupling member 150 so that the coupling member 150 and the driving shaft 100 attract each other, and the assured contact is stabilized between free end portion 100*a* and driving shaft receiving surface 150*f* to establish the assured rotational force transmission.

Two rotational force transmitting pins 100*b* as the rotational force applying portions of the driving shaft 100 are projected in the opposite directions relative to each other with respect to the direction substantially perpendicular to the axis of the driving shaft, and projects. Any one of the rotational force receiving portions 150*e* (150*e*1-150*e*4) engages with one of the rotational force transmitting pins 100*b*. In addition, the other one of the rotational force receiving portions engages with the other one of rotational force transmitting pins 100*b*. By this, the coupling member 150 receives the rotational force from the driving shaft 100 to rotate.

The expanded part of driving shaft receiving surface 150*f* of the coupling member 150 has a conical shape, as shown in FIG. 8. This conical shape has an apex a on the rotation axis of the coupling member 150. FIG. 8 shows the state that the coupling member 150 is at the rotational force transmitting angular position. In this state, the rotation axis L150 of the coupling member 150 is coaxial substantially with the axis of the drum 20. And, an apex a of the conical shape of the driving shaft receiving surface 150*f* opposes to the free end of the driving shaft 100, and the coupling member 150 covers the free end of the driving shaft 100 to transmit the rotational force to the coupling member 150. The rotational force receiving portions 150*e* (150*e*1-150*e*4) are disposed at equal intervals in the circumferential direction of the rotation of the coupling member 150.

Figure 9:
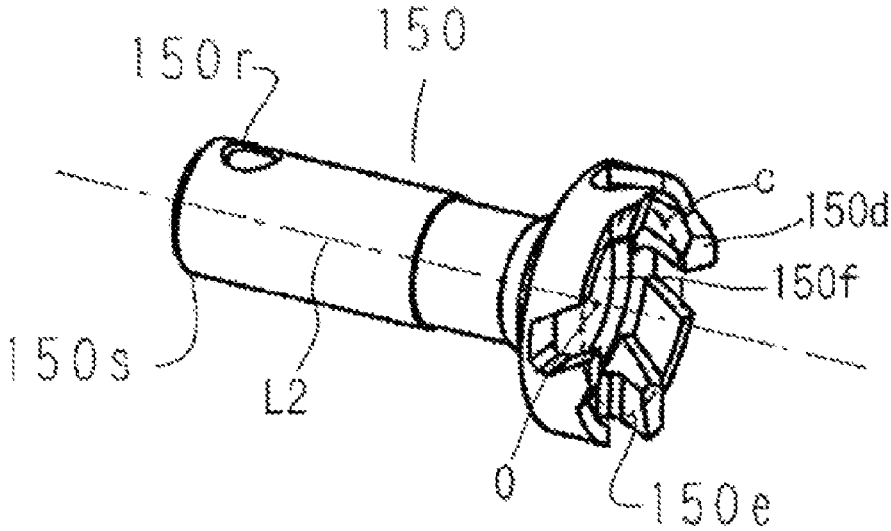
FIG. 9 is a perspective view illustrating the coupling member.
Figure 10:
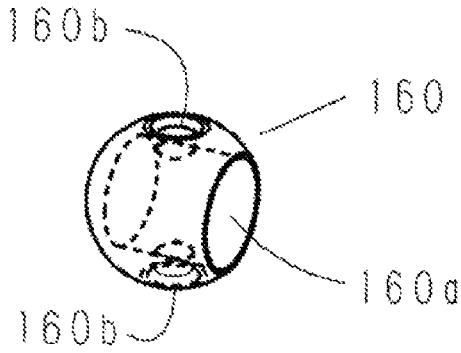
FIG. 10 is a perspective view illustrating a spherical member.
Figure 11:
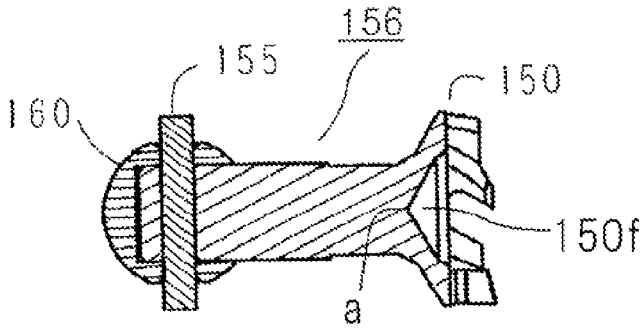
FIG. 11 is a sectional view illustrating the coupling member and a connecting part.
Figure 12:
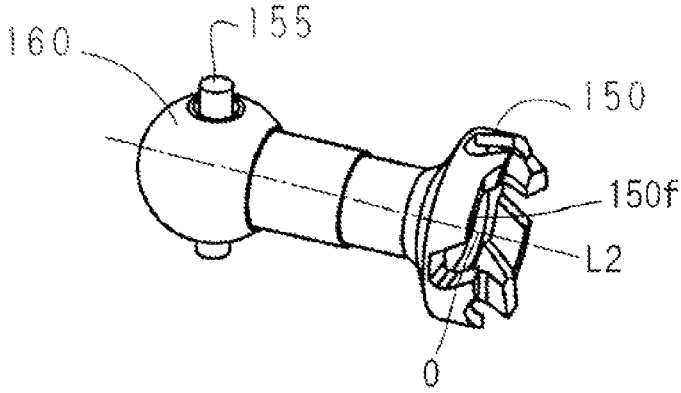
FIG. 12 is a perspective view illustrating the coupling member and the connecting parts.

4) Coupling and connection parts FIG. 9 is a perspective view illustrating the coupling member 150. FIG. 10 is a perspective view illustrating a spherical member 160. FIG. 11 is a sectional view illustrating the coupling member 150 and a connection part. FIG. 12 is a perspective view illustrating the coupling member 150 and the connection parts.

A through-hole 150*r* is provided adjacent to the end 150*s* of the opposite side of the coupling member 150 from the rotational force receiving portion 150*e*. A spherical member 160 for connecting with the coupling member 150 has a substantially spherical shape, and a hole for inserting the coupling member 150, and a pin 155 as will be described hereinafter are provided. A hole 160*a* closed at one end is a portion into which the end 150*s* of the coupling member 150 is inserted. In addition, through-hole 160*b* is a portion into which the pin 155 is inserted as will be described hereinafter, and it penetrates one-end-closed hole 160*a*.

As shown in FIGS. 11 and 12, the end 150*s* of the coupling member 150 is inserted into hole 160*a* of the spherical member 160, and the pin 155 is inserted in the state that the through-hole 150*r* and the through-hole 160*b* are aligned with each other. In the present embodiment, the coupling member 150 and the hole 160*a* are engaged with a loose-fit, the pin 155 and the through-hole 150*r* are engaged with a loose-fit, and the pin 155 and the through-hole 160*b* are engaged with a tight-fit. Accordingly, the pin 155 and the spherical member 160 are connected integrally. This combined structure constitutes a coupling assembly 156.

When the coupling member 150 receives the rotational force from the driving shaft 100, it rotates about the axis L150 and the edge of through-hole 150*r* abuts to the pin 155. In other words, the rotational force from the main assembly 1 is converted to the force for rotating the pin 155 about the rotation axis L150 through the coupling member 150.

Figure 13:
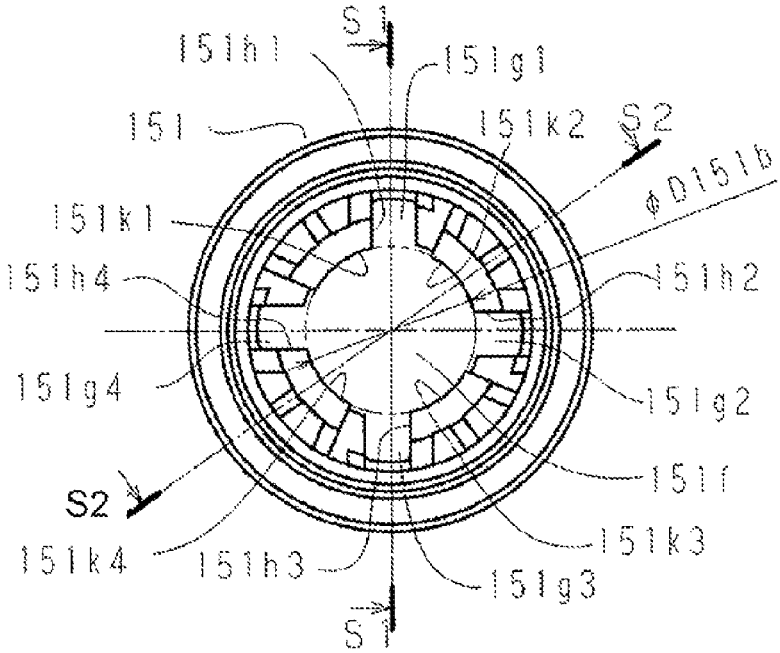
FIG. 13 is an illustration of a drum flange.
Figure 14:
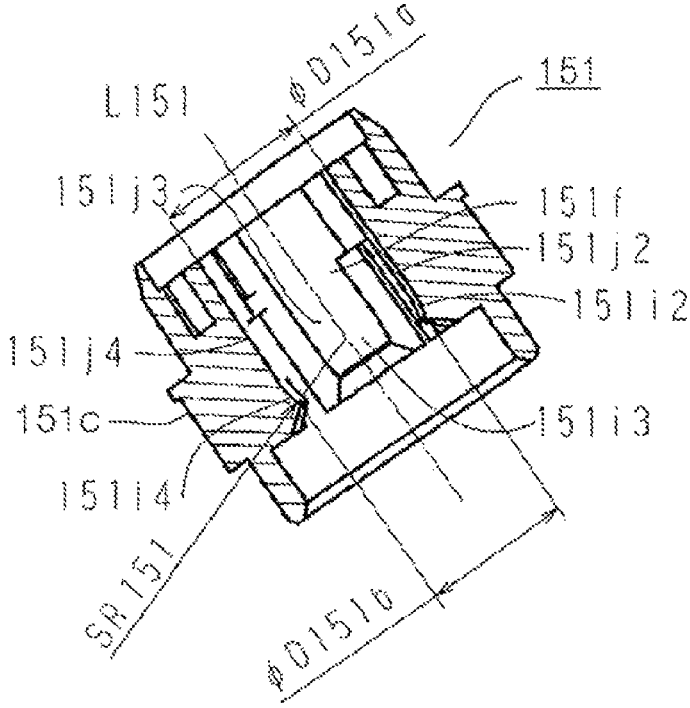
FIG. 14 is a sectional view taken along a line S2-S2 in FIG. 13.
Figure 15:
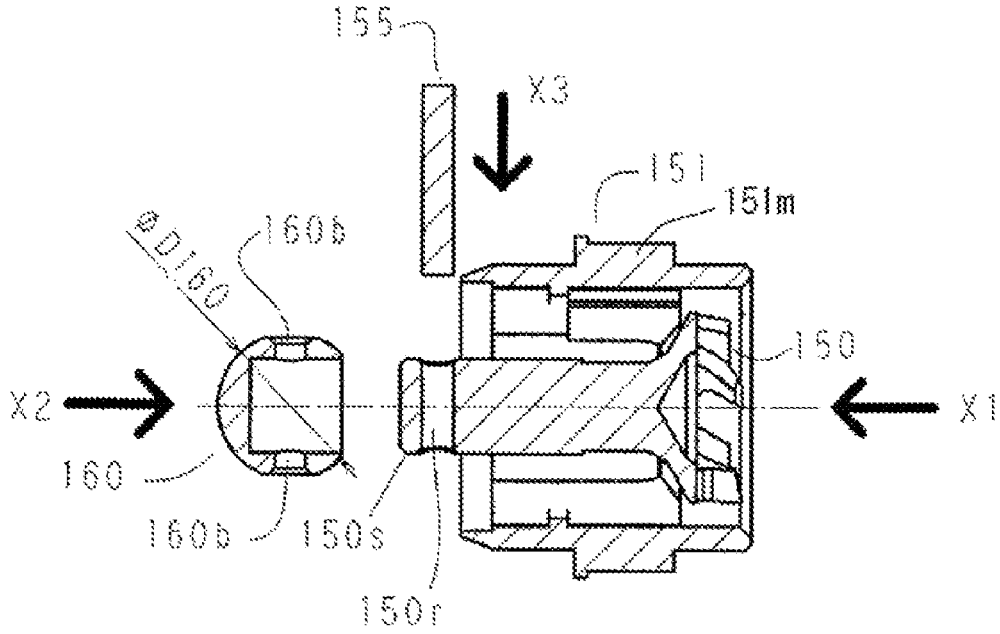
FIG. 15 is a sectional view taken along a line S1-S1 in FIG. 13, illustrating a process of mounting the coupling member to the drum flange.
Figure 16:
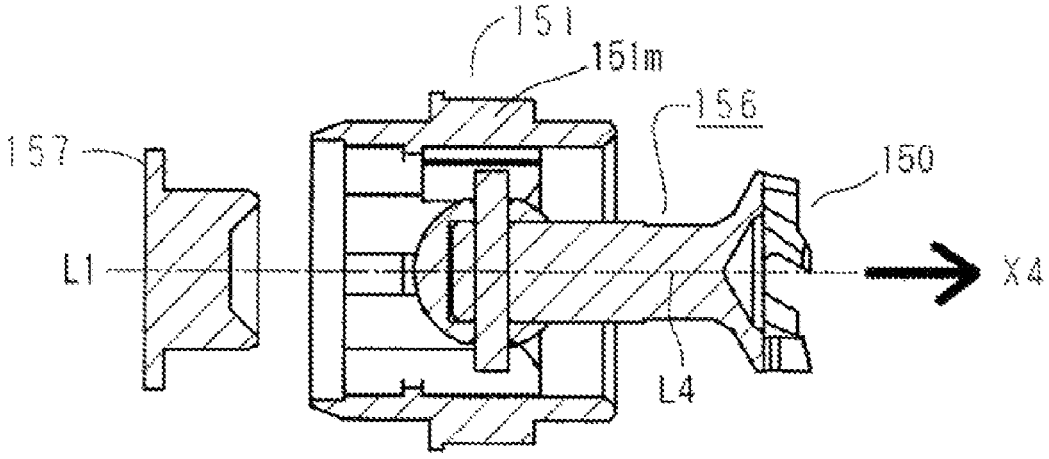
FIG. 16 is a sectional view taken along a line S1-S1 in FIG. 13, illustrating a process of fixing the coupling member to the drum flange.
Figure 17:
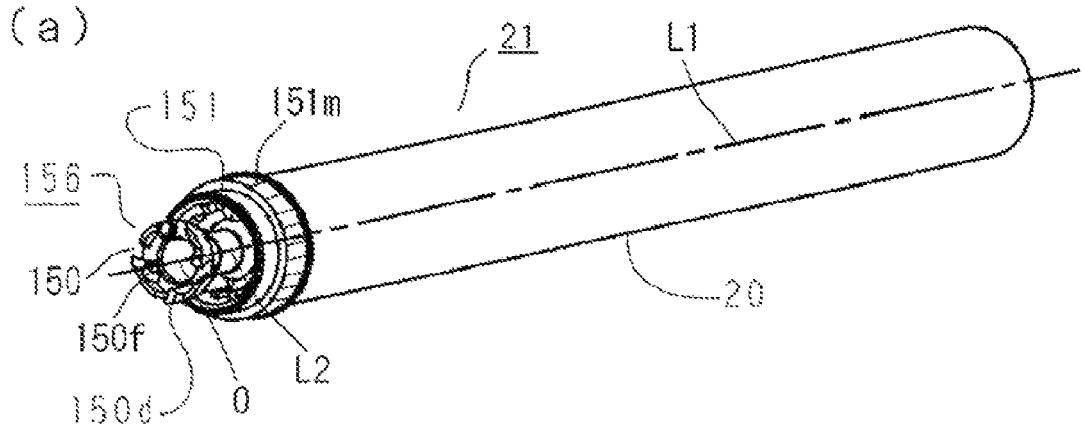
FIG. 17 is a schematic perspective view of an electrophotographic photosensitive drum unit as seen from a driving side.
Figure 17:
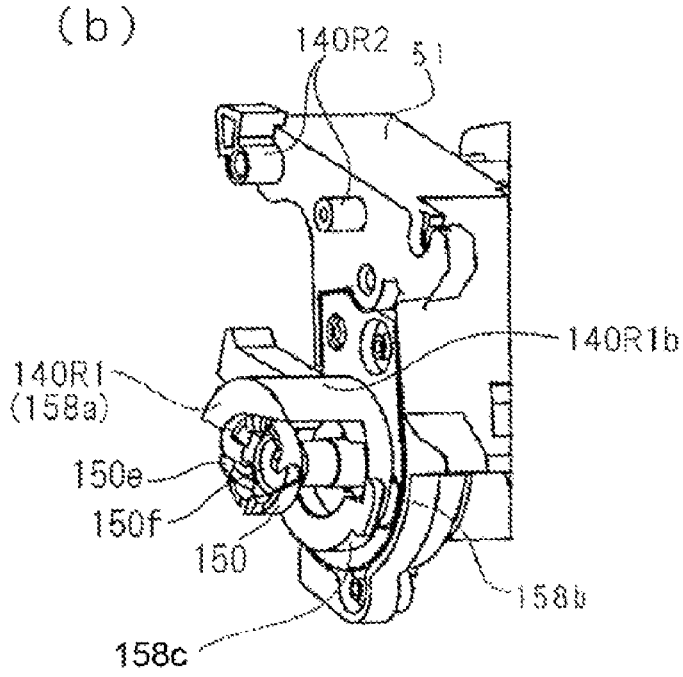
Figure 18:
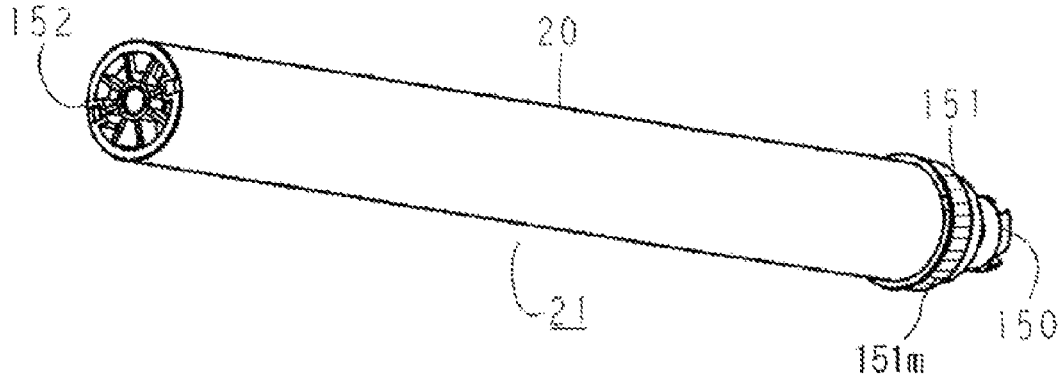
FIG. 18 is a schematic perspective view of the electrophotographic photosensitive drum unit as seen from a non-driving side.
Figure 18:
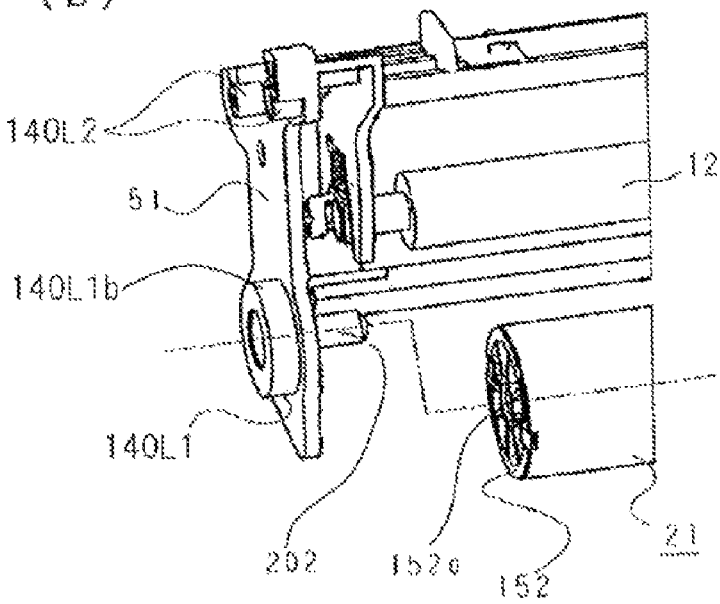

5) Rotational force transmission to drum 20 from coupling assembly 156 FIG. 13 is an illustration of drum flange 151 (flange). FIG. 14 is a sectional view taken along a line S2-S2 in FIG. 13. FIG. 15 is a sectional view illustrating a process of attaching the coupling member 150 to the flange 151 with a view taken along a line S1-S1 of FIG. 13. FIG. 16 is a sectional view illustrating a process fixing the coupling member 150 to the flange 151 with a view taken along a line S1-S1 of FIG. 13. FIG. 17 is a perspective view of the electrophotographic photosensitive drum unit 21, as seen from a driving side (coupling member 150). FIG. 18 is a perspective view of the electrophotographic photosensitive drum unit 21, as seen from a non-driving side (opposite end portion).

Referring to FIG. 13 and FIG. 14, an example of a flange 151 for mounting the coupling member 150 will be described. FIG. 13 shows the flange 151, as seen from the driving shaft 100 side. The opening 151*g* (151*g*1-151*g*4) shown in FIG. 13 is a groove extended in the rotation axis direction of the flange 151. When the coupling member 150 is mounted to the flange 151, the pin 155 is received by any two of this openings 151*g*1-151*g*4. Furthermore, the clockwisely upstream parts of the openings 151*g*1-151*g*4 is provided with rotational force transmitting surfaces (rotational force receiving portion) 151*h* (151*h*1-151*h*4). When the rotational force is transmitted to the flange 151 from the pin 155, the pin 155 and rotational force transmitting surface 151*h* contact to each other. In addition, a space (recess 151*f*) is provided adjacent the center axis L151 of the flange 151. The flange 151 has a gear 151*m* (FIG. 15, FIG. 16, FIG. 17, and FIG. 18). The gear 151*m* transmits the rotational force received from the coupling member 150 driving shaft 100 to the developing roller 41.

The recess 151*f* is a space surrounded by a cylinder surface 151*j* (151*j*4-151*j*4), a retaining portion 151*i* (151*i*1-151*i*4), and an opening 151*k* (151*k*1-151*k*4). The cylinder surface 151*j* (151*j*4-151*j*4) is a substantial cylinder surface which is adjacent to the opening 151*g* and which has a center on the axis L151, and it is a portion of the cylinder surface which has a diameter D151*a*. The retaining portion 151*i* (151*i*1-151*i*4) has a substantially semispherical surface which is smoothly continuous with the cylindrical surface 151*j*, and it has a radius SR151. The opening 151*k* (151*k*1-151*k*4) is disposed on the driving shaft 100 side of retaining portion 151*i*, and it is an opening which has a diameter D151*b*.

A relation between them and the outside dimension D160 of the spherical member 160 is as follows (FIG. 14, FIG. 15).

D151*b*<D160<D151*a*≈2xSR151 The spherical member 160 can be inserted into recess 151*f* with a gap, but it is prevented from moving toward the opening 151*k* in the direction of the axis L151. A spherical member 160 (coupling assembly 156) does not separate from the flange 151 (process cartridge 2) under the normal condition by this prevention.

The coupling member 150 has a gap between the rotational force transmitting pin 155 (rotational force transmitting portion) and the rotational force transmitting surface (rotational force receiving portion) 151*h* so that it is pivotable substantially in all directions relative to the axis L1 of the drum 20. The pin 155 is movable relative to the rotational force transmitting surface 151*h*. In this manner, the coupling member 150 is mounted to the end of the drum 20 so that the pin 155 and rotational force transmitting surface 151*h* contact with each other in the rotational direction of the coupling member 150. Referring to FIGS. 15 and 16, the process for mounting and fixing the coupling member 150 to the flange 151 will be described. The end 150*s* is inserted in the direction of the arrow X1 into the flange 151. Then, the spherical member 160 is placed in the arrow X2 direction. Furthermore, the through-hole 160*b* of the spherical member 160 and the through-hole 150*r* of end 150*s* are co-axially aligned, and the pin 155 is inserted in the direction of the arrow X3 after that. The pin 155 penetrates the through-hole 160*b* and the through-hole 150*r*. Since the inner diameters of through-hole 160*b* and through-hole 150*r* are smaller than a diameter of the pin 155, the frictional force occurs between the pin 155 and through-hole 160*b* and between the pin and through-hole 150*r*. The interference is about 50 micrometers in the present embodiment.

By this, at the time of the ordinary use, the pin 155 is retained assuredly, and the coupling assembly 156 is maintained integral.

The coupling assembly 156 is moved in an X4 direction, and the spherical member 160 is contacted or approached to the retaining portion 151*i*.

Then, the retention member 157 is inserted in the arrow X4 direction to fix to the flange 151. Since the play (gap) is provided relative to the spherical member 160, the coupling member 150 can change the orientation.

Referring to FIG. 17 and FIG. 18, the structure of electrophotographic photosensitive drum unit 21 (photosensitive drum unit) will be described. The flange 151 which is provided with the coupling assembly 156 is fixed to the end side of the drum 20 so that drive receiving projection 150*d* is exposed. Non-driving side drum flange 152 is fixed to the other end side of the drum 20. The fixing method may be crimping, bonding, welding or the like. The photosensitive drum unit 21 is supported rotatably by the drum frame 51 in the state that the driving side is supported by the bearing member 15, and the non-driving side is supported by the photosensitive drum unit supporting pin 202. The non-driving side is supported rotatably in hole 152*a* of drum flange 152 by the pin 202.

In the present embodiment, the coupling member 150 is mounted to the end of the drum 20 through the flange 151, and is pivotable and revolvable in all directions substantially, relative to the axis L1 of the drum 20.

As has been described hereinbefore, the rotational force from the motor (unshown) of the main assembly 1 rotates the driving shaft 100 through the drive transmitting means (unshown), such as the gear of the main assembly 1. The rotational force thereof is transmitted to the cartridge 2 through this the coupling member 150. Furthermore, the rotational force is transmitted through the pin 155 from the coupling member 150 to the flange 151, and it is transmitted to the drum 20 integrally fixed to the flange 151. Designated by 151*c* is a gear, and the rotational force received by the coupling member 150 from the driving shaft 100 is transmitted to the developing roller 41 (FIG. 2). The gear 151*c* is integrally molded with the flange 151.

(Mounting and Demounting Structure of the Cartridge 2)

Figure 19:
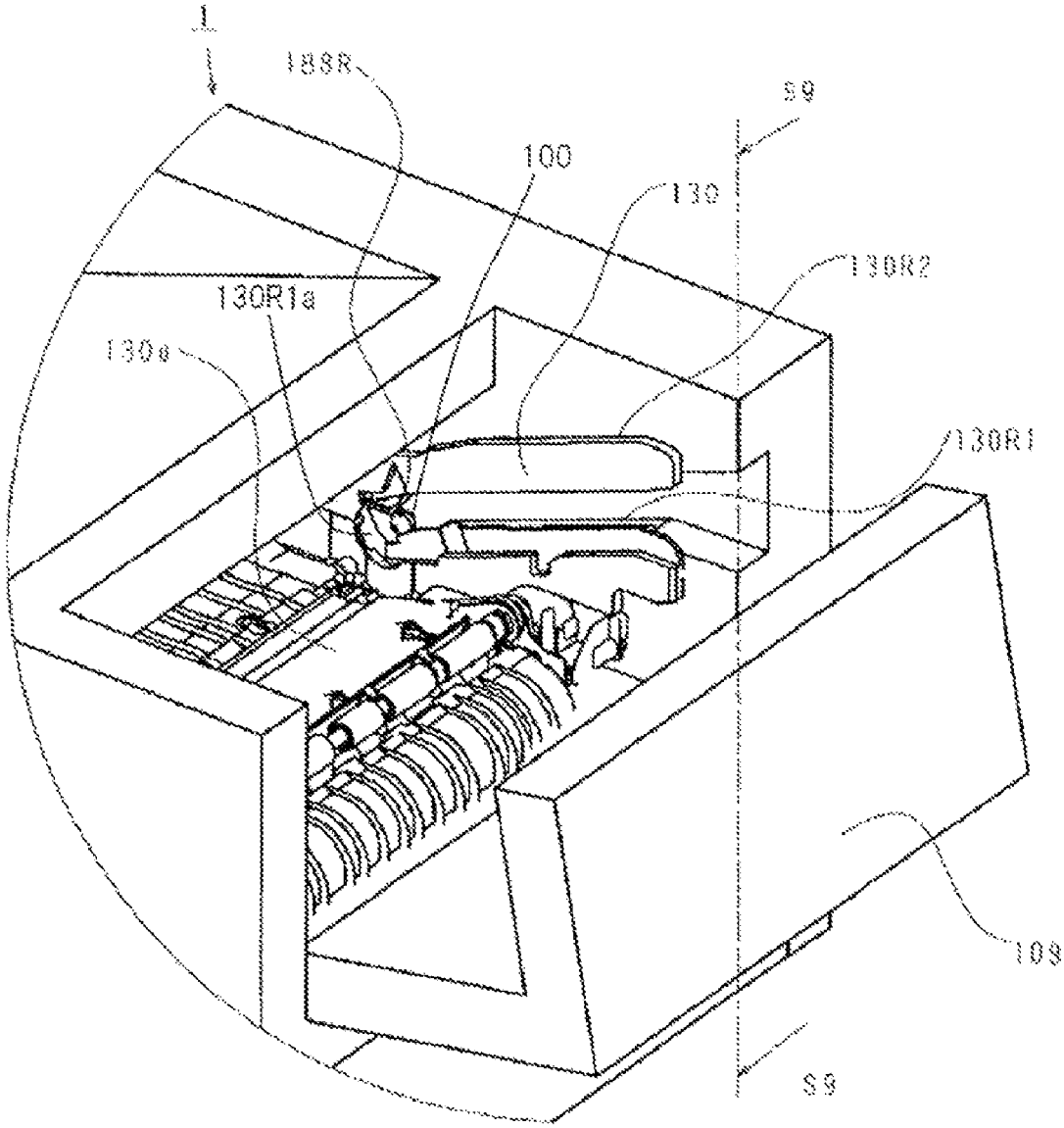
FIG. 19 is a perspective view of a cartridge set portion of the main assembly of the apparatus.
Figure 20:
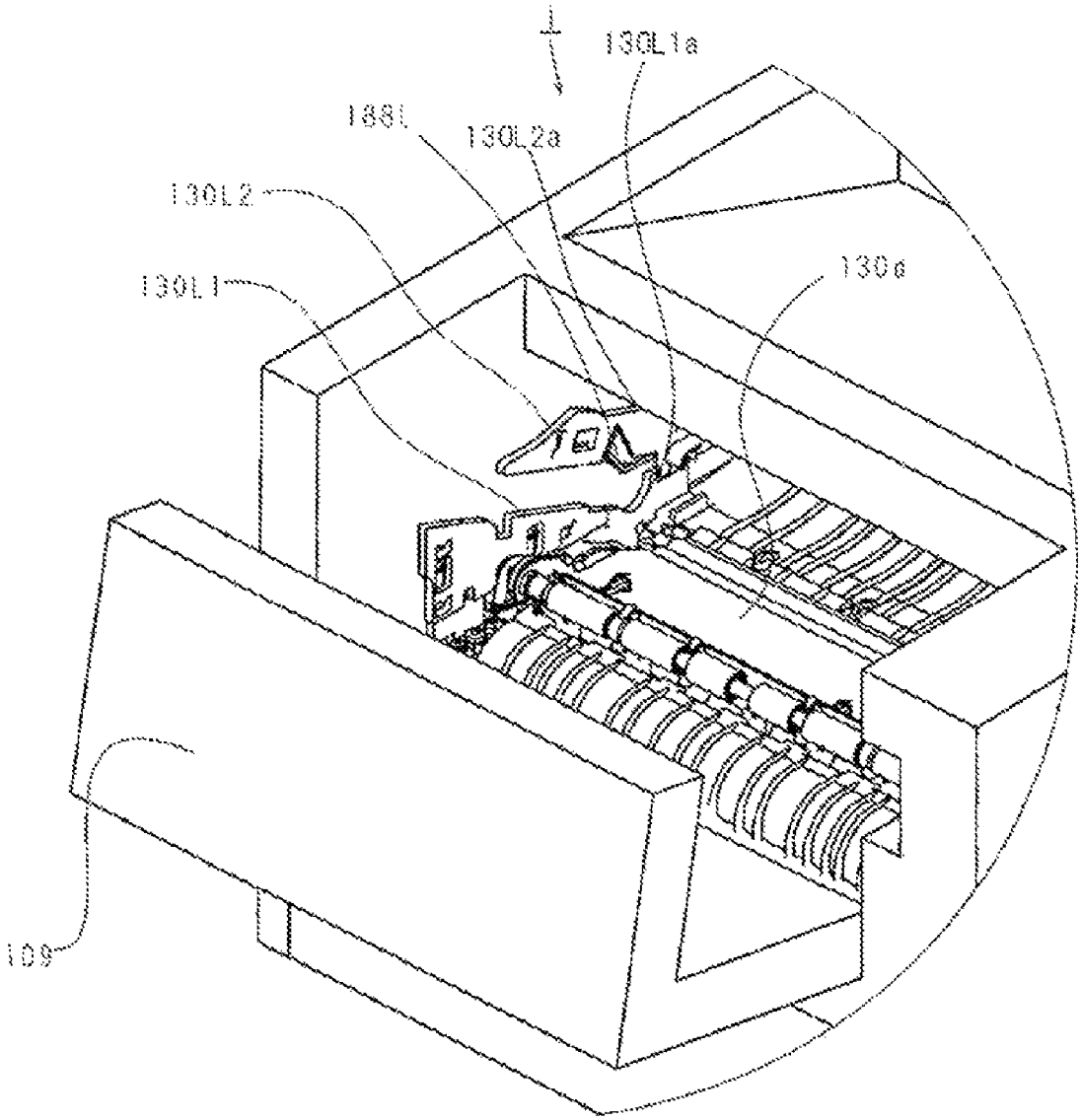
FIG. 20 is a perspective view of a cartridge set portion of the main assembly of the apparatus.

The mounting guide for mounting the cartridge 2 to the main assembly 1 will be described. The mounting means 130 of the present embodiment includes the main assembly guides 130R1, 130R2, 130L1, 130L2 provided in the main assembly 1. They are provided on the right and left internal surfaces of the cartridge mounting space (cartridge set portion 130*a*) provided in the main assembly 1. (FIG. 19 shows the driving side and FIG. 20 shows the non-driving side). Correspondingly to the driving side of the cartridge 2, the main assembly guide 130R1, 130R2 extends along the mounting direction of the cartridge 2. On the other hand, correspondingly to the non-driving side of the cartridge 2, the main assembly guides 130L1, 130L2 extend along the mounting direction of the cartridge 2. The main assembly guides 130R1, 130R2 and the main assembly guides 130L1, 130L2 are opposed to each other. In mounting the cartridge 2 to the main assembly 1, the cartridge guides as will be described hereinafter are guided by the guides 130R1, 130R2, 130L1, 130L2 in order to mount the cartridge 2 to the main assembly 1, the cartridge door 109 which is openable and closable relative to the main assembly 1 is opened. The mounting relative to the main assembly 1 of the cartridge 2 is completed by closing the door 109. Also, in taking the cartridge 2 out of the main assembly 1, the door 109 is opened. These operations are carried out by the user.

The mounting guides of the cartridge 2 and the positioning portion relative to the main assembly 1 will be described. In the present embodiment, the outer periphery 158*a* of the outside end of the bearing member 158 functions also as a cartridge guide 140R1. The cylindrical portion 51*a* of the drum frame functions also as the cartridge guide 140L1. Designated by 158*h* is a bearing, and supports the drum 20 rotatably (FIG. 22 (C), FIG. 26). The bearing 158*h* is provided in a bearing member 158.

One longitudinal end portion (driving side) of the drum frame 51 is provided with a cartridge guide 140R2 substantially above the cartridge guide 140R1. The other longitudinal end portion (non-driving side) is provided with a cartridge guide 140L2 substantially above the cartridge guide 140L1.

The one longitudinal end portion of the drum 20 is provided with the cartridge side guides 140R1, 140R2 outwardly projected from the drum frame 51. The other longitudinal end portion is provided with the cartridge side guides 140L1, 140L2 which outwardly projects from the drum frame 51. The guides 140R1, 140R2, 140L1, 140L2 outwardly project along the longitudinal direction. The guides 140R1, 140R2, 140L1, 140L2 project from the drum frame 51 along the axis L1 of the drum 20. When the cartridge 2 is mounted to the main assembly 1, and when the cartridge 2 is demounted from the main assembly 1, the guide 140R1 is guided by the guide 130R1, and the guide 140R2 is guided by the guide 130R2. When the cartridge 2 is mounted to the main assembly 1, and when the cartridge 2 is demounted from the main assembly 1, the guide 140L1 is guided by the guide 130L1, and the guide 140L2 is guided by the guide 130L2. Thus, the cartridge 2 is moved in the direction substantially perpendicular to the axial direction L3 of the driving shaft 100 and is mounted to the main assembly 1, and it is moved and demounted from the main assembly 1 in the direction. The cartridge guides 140R1, 140R2 are molded integrally with the second frame 118 in the present embodiment. However, separate members may be used as the cartridge guides 140R1, 140R2.

Figure 21:
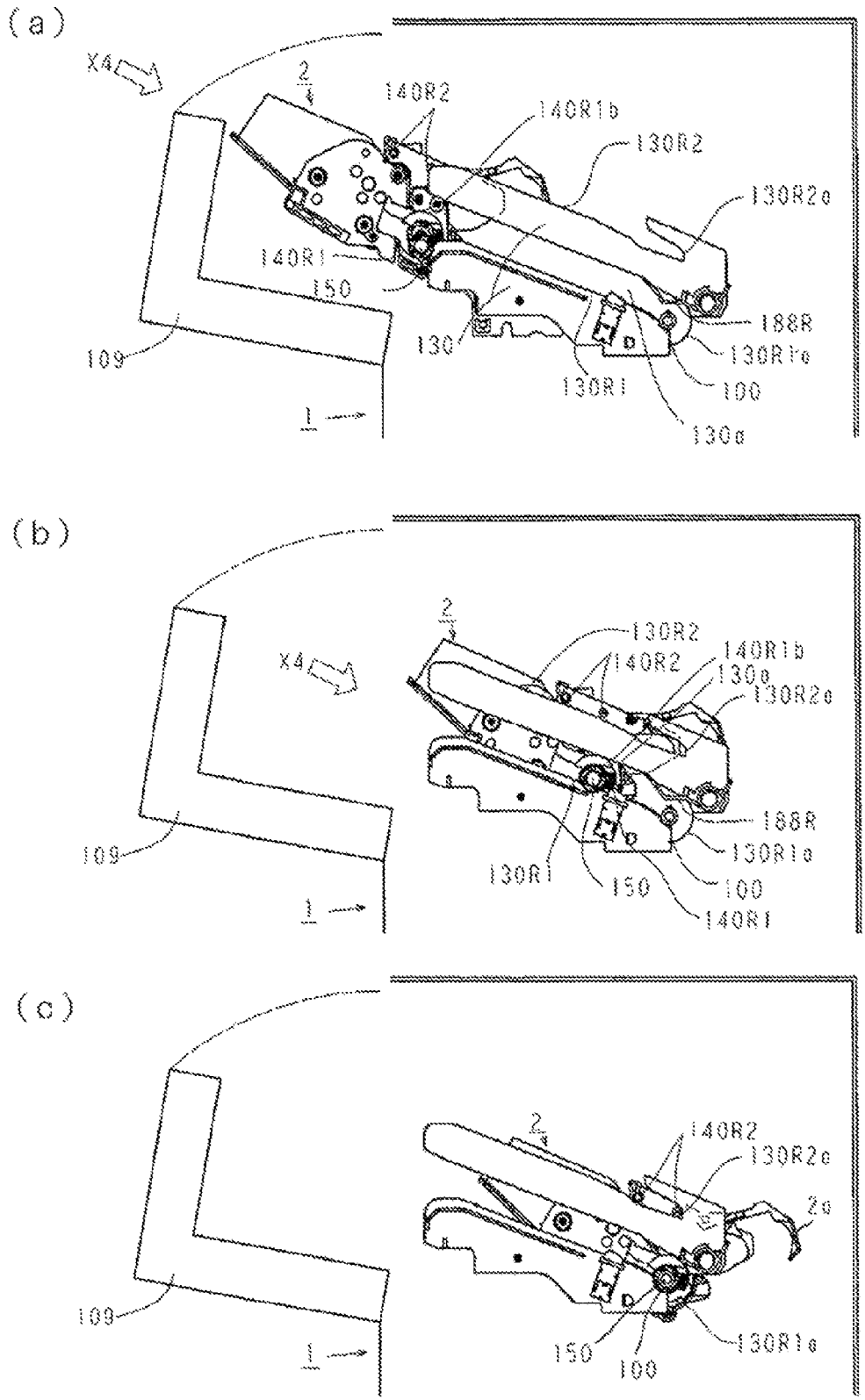
FIG. 21 is a sectional view illustrating a process of mounting the cartridge to the main assembly of the apparatus.

The mounting operation of the process cartridge will be described. Referring to FIG. 21, the mounting operation of the cartridge 2 relative to the main assembly 1 will be described. FIG. 21 shows the mounting process. FIG. 21 is the sectional view taken along a line S9-S9 in FIG. 19.

As shown in (a) of FIG. 21, the user opens the door 109, and mounts the cartridge 2 removably relative to the cartridge mounting means 130 (set portion 130*a*) provided in the main assembly 1.

As shown in (b) of FIG. 21, when the cartridge 2 is mounted to the main assembly 1, the cartridge guides 140R1,140R2 are guided by the main assembly guides 130R1,130R2 in the driving side. The cartridge guides 140L1, 140L2 ((b) of FIG. 3) are guided along the main assembly guide 130L1, 130L2 (FIG. 20) also in the non-driving side.

Referring to (a), (b) and (c) of FIG. 22, the detailed description will be made as to the state until the cartridge 2 is inserted to the main assembly guide (130R1), and as to the configuration of the drum bearing member 158 as the regulating portion for regulating the coupling member 150.

As described above, the coupling member 150 is pivotable in photosensitive drum unit 21. Therefore, when the cartridge 2 is outside main assembly 1, it normally inclines downward by the gravity.

Figure 22:
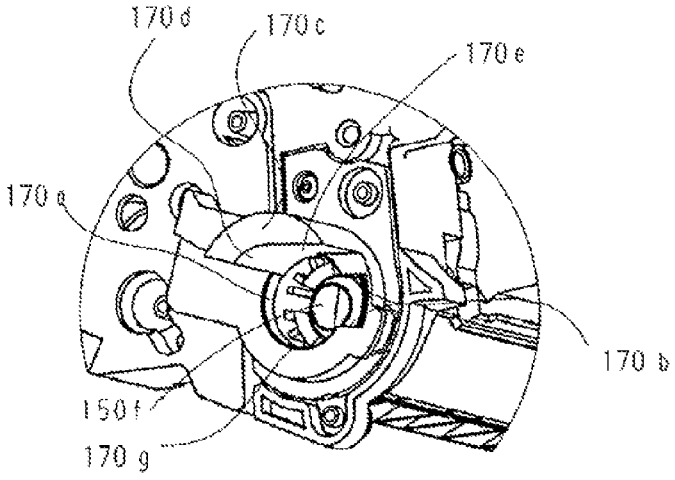
FIG. 22 is a sectional view of a drum bearing.
Figure 22:
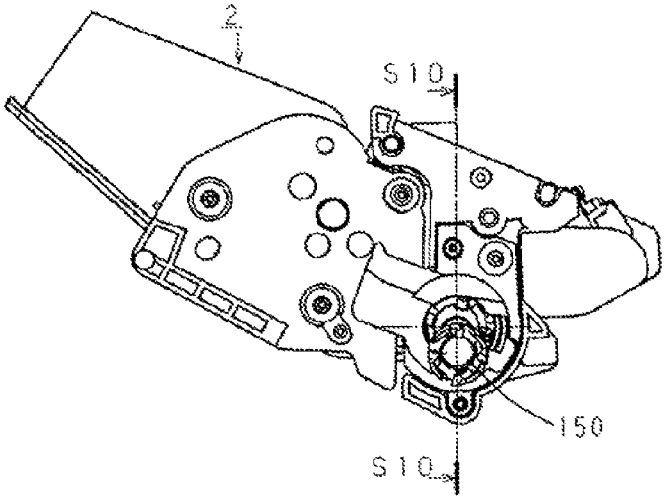
Figure 22:
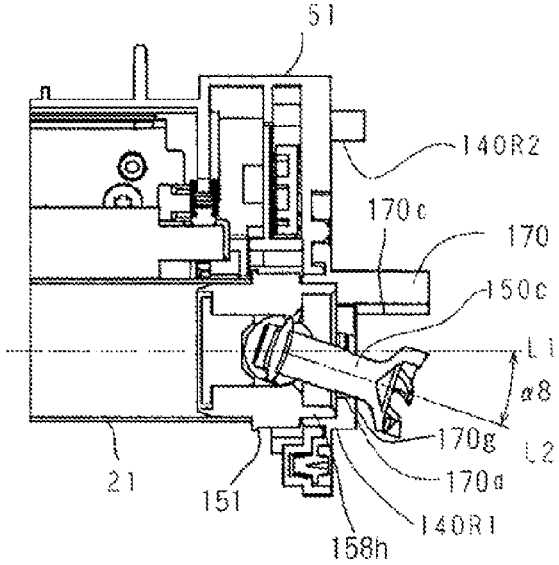

In FIG. 22, (a) is a perspective view in the neighborhood of the drum bearing member of the cartridge 2, and the coupling is omitted for better understanding. (b) of FIG. 22 is a side view of the cartridge 2. (c) of FIG. 22 is a sectional view of the cartridge 2 taken along a line S10 of (b) of FIG. 22, wherein the orientations of the axis L1 of photosensitive drum unit 21 (drum 20), and the inclined axis L2 of the coupling member 150 are shown.

The configuration of the drum bearing member 158 will be described using (a) of FIG. 22. The drum bearing member 158 is provided with a regulating portion 170 for regulating the motion of the coupling member 150 around the hole 158*f* penetrated by the coupling member 150. More particularly, the bearing member 158 is provided with the regulating portion 170. This regulating portion 170 regulates the inclination angle of the coupling member 150 so that the inclination angle of the coupling member 150 relative to the axis L1 of the drum 20 in the pre-engagement angular position is the larger than the inclination angle in other angular position (rotational force transmitting angular position, pre-engagement angular position). More particularly, the regulating portion 170 regulates the inclination angle of the coupling member 150 so that the angle of the inclination of the coupling member 150 by the weight is smaller then the angle when the coupling member 150 takes the pre-engagement angular position (second angular position). Here the rotational force transmitting angular position is a first angular position. The pre-engagement angular position is a second angular position. The disengaging angular position is a third angular position.

The drum bearing member 158 is provided with a hole 150*f*. The coupling member 150 is pivotable in the range surrounded in hole 150*f*. Along with the outer periphery of hole 150*f*, a first arc part 170*a* which has an inclination regulating portion 170*g* is provided. The coupling member 150 penetrates this hole 150*f* at the time of the assemblying operation. In the state that the cartridge 2 is outside the main assembly 1, an inclination regulating portion 170*g* is provided below the hole 150*f*. The inclination regulating portion 170*g* regulates the inclination angle of the coupling member 150 in the state that the cartridge 2 is outside main assembly 1. A projection regulating portion 170*c* projected outside in the axis L1 direction from a part of edge of hole 158*f* is provided with a second arc part 170*d* and a flat surface portion 170*e* connected with the second arc part 170*d*. The projection regulating portion 170*c* constitutes an inclination regulating portion 140R1*a* as will be described hereinafter. The inclination regulating portion 140R1*a* regulates the inclining direction of the coupling member 150 between the left side from the upper surface. Therefore, the coupling member 150 can be freely inclined only in the mounting direction (X4) substantially. The inclination regulating portion 140R1*a* will be described hereinafter referring to FIG. 24 and FIG. 30.

Figure 29:
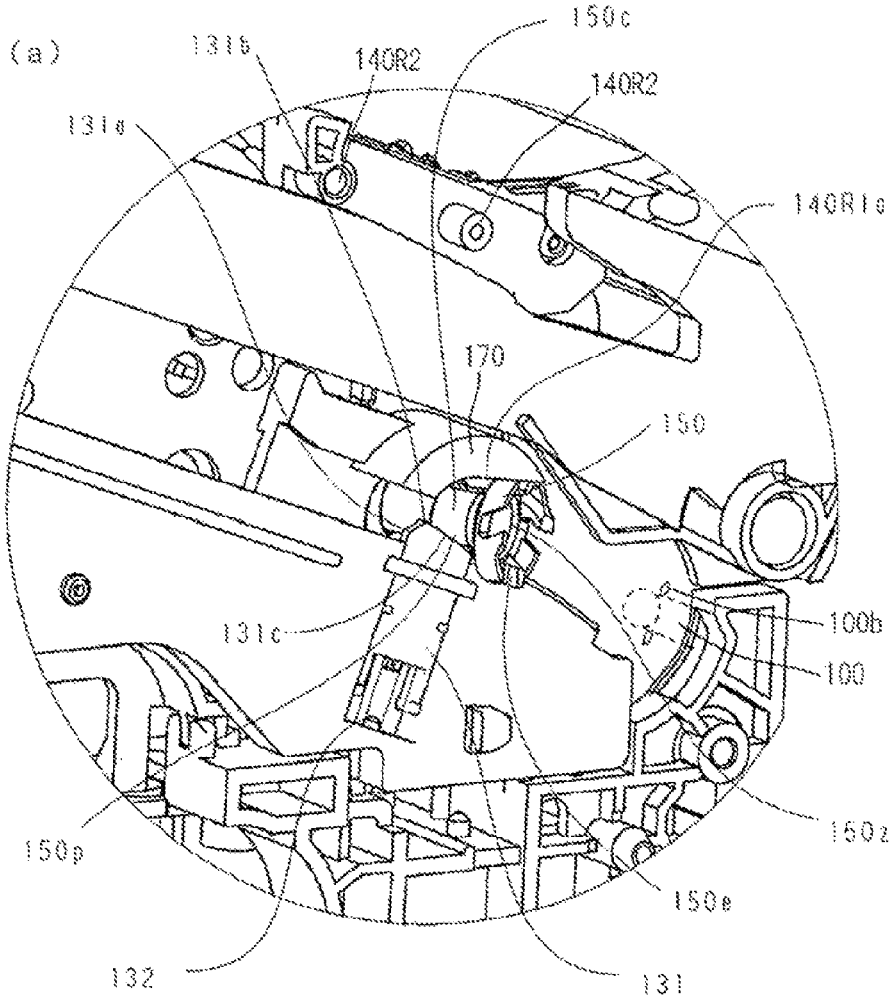
FIG. 29 is a perspective view illustrating a relation between the main assembly guide and the coupling.
Figure 29:
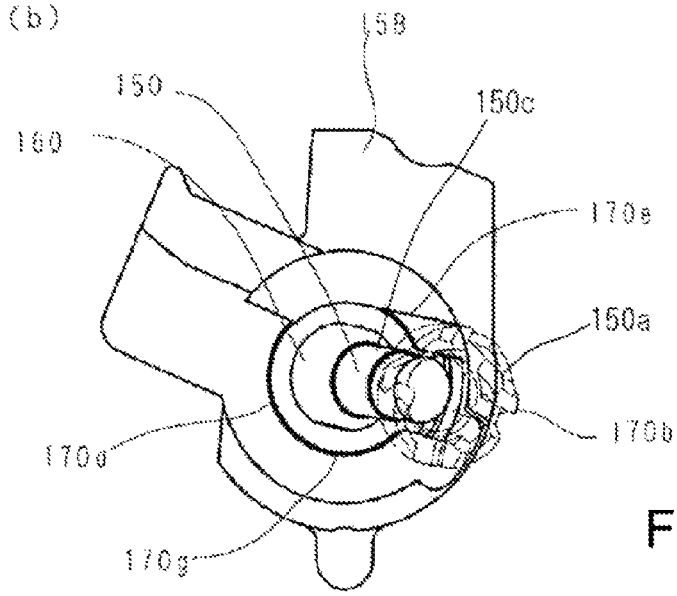

As shown in (c) of FIG. 22, in the state that the cartridge 2 is outside main assembly 1, the axis L2 of the coupling member 150 is inclined to the position where the coupling member 150 is held by inclination regulating portion 170*g* of the regulating portion 170. More particularly, an intermediate part 150*c* of the coupling member 150 contacts to inclination regulating portion 170*g* to be regulated in the inclination angle (FIG. 22 (C)). The inclination regulating portion 170*g* holds the intermediate part 150*c* of the coupling member 150 until the coupling member 150 is guided by the main assembly guide 130R1, after the cartridge 2 is inserted into the main assembly 1. In other words, it regulates the inclination angle of the coupling member 150. Therefore, the inclination regulating portion 170*g* is not extended over the entire area in the circumferential direction of the hole 150*f*. The a part of the neighborhood of hole 150*f* is provided with a projection 170*b* for making larger the inclination angle of the coupling member 150 than the inclination angle in the other neighborhood of hole 150*f*. The projection 170*b* projects in the radial direction (radial direction) of hole 150*f* from the circumference of hole 150*f*. The projection 170*b* regulates the inclination angle of the coupling member 150 at the position remoter than the projection the regulating portion 170*c* and the inclination the regulating portion 170*g* with respect to the radial direction from the axis L1 of the drum 20 (FIG. 29 (*a*)). FIG. 29 (*a*) shows the state that the coupling member 150 is regulated by the projection 170*b* in the inclination angle. In FIG. 22 (*c*), the driven portion 150*a* of the coupling member 150 is illustrated by the broken lines. The inclination angle of the coupling member 150 is regulated by the inclination regulating portion 170*g* at the inclination angle alpha 8. By this, in mounting the cartridge 2 to the main assembly 1, the coupling member 150 is transferred to the inserting portion 130R2 with a small impact, without interfering with the inserting portion 130R2 of the main assembly guide 130. The coupling member 150 is elastically urged by a slider 131 until it is positioned to the main assembly 1. The coupling member 150 is guided to the projection 170*b*, while abutting to the second arc part 170*d* and the flat surface portion 170*e* of the projection regulating portion 170*c*. Before contacting the coupling member 150 to the driving shaft 100, it takes the pre-engagement angular position. Therefore, the coupling member 150 can be engaged assuredly and smoothly with the driving shaft 100. The coupling member 150 receives an external force (second external force) from the slider 131.

When the cartridge 2 is further inserted in the arrow X4 direction, the driving shaft 100 and the coupling member 150 engage with each other, and subsequently the cartridge 2 is mounted to the predetermined position (set portion 130*a*) (setting). In other words, the cartridge guide 140R1 contacts to positioning portion 130R1*a* of the main assembly guide 130R1, and the cartridge guide 140R2 contacts to positioning portion 130R2*a* of the main assembly guide 130R2. In addition, the cartridge guide 140L1 contacts to the positioning portion 130L1*a* (FIG. 20) of the main assembly guide 130L1, and, the cartridge guide 140L2 contacts to the positioning portion 130L2*a* of the main assembly guide 130L2. Since the situation is substantially symmetrical, the illustration is omitted for simplicity. In this manner, the cartridge 2 is removably mounted to set portion 130*a* by the mounting means 130. In other words, the cartridge 2 is mounted to the main assembly 1 in place. And, in the state that the cartridge 2 is set to the set portion 130*a*, the engagement between the driving shaft 100 and the coupling member 150 is established. More particularly, the coupling member 150 takes the rotational force transmitting angular position as will be described hereinafter. When the cartridge 2 is mounted to the set portion 130*a*, the image forming operation is enabled. When the cartridge 2 is set to the predetermined position as described above, the pressing receptor portion 140R1*b* ((a) of FIG. 3) of the cartridge 2 receives an urging force from the urging spring 188R (FIG. 19). The pressing receptor portion 140L1*b* ((b) of FIG. 3) of the cartridge 2 receives the urging force by the urging spring 188L (FIG. 20). By this, the cartridge 2 (drum 20) is accurately positioned relative to the transfer roller, the optical means, and so on of the main assembly 1.

In this manner, the cartridge 2 is provided with the cartridge guides 140R1, 140R2, 140L1, 140L2 guided in the direction perpendicular to the direction of the axis L1 of the drum 20. By this, the cartridge 2 is mounted to the main assembly 1, while moving in the direction substantially perpendicular to the axis L3 of the driving shaft 100. The cartridge 2 is demounted from the main assembly 1 in the same direction.

As described above, the regulating portion 170 is provided around the coupling member 150 in the orthogonality direction substantially perpendicular to the axis L1 of the drum 20. More particularly, in the regulating portion 170, a portion of the intermediate part 150*c* of the coupling member 150 is surrounded with a gap so that the coupling member 150 can be revolved. As has been described hereinbefore, the regulating portion 170 is provided with a first arc part 170*a* and the projection 170*b* which projects in the orthogonality direction continuing with the first arc part 170*a*. The inclination angle of the coupling member 150 inclined by the weight is regulated by the first arc part 158*a*, and the projection 158*b* regulates the inclination angle of the coupling member 150 in the pre-engagement angular position.

In this manner, when the coupling member 150 inclines by the weight thereof, the inclination angle of the coupling member 150 is regulated by the inclination regulating portion 170*g* of the first arc part 158*a* contacting to the intermediate part 150*c*. The projection 170*b* regulates the inclination angle of the coupling member 150 in the pre-engagement angular position.

In the present embodiment, the inclination angle in the pre-engagement angular position is about 30 degrees, and the inclination angle regulated by first arc part 158*a* is about 20 degrees (in FIG. 22 (*c*) alpha 8). However, the present invention is not limited to this angle, but another inclination angle may be selected properly by one skilled in the art. The inclination angle of the coupling member 150 is regulated by the first arc part 170*a*. In other words, in the case where the inclination angle of the coupling member 150 is regulated, the inclination angle of the coupling member 150 is regulated so that it is smaller than the inclination angle when the coupling member 150 is at the pre-engagement angular position (second angular position). More specifically, in the radial direction from the axis L1, the position where the projection 170*b* regulates the inclination angle of this the coupling member 150 is set at a remote position from the position where the first arc part 158*a* regulates the inclination angle of this the coupling member 150.

Here, the angle when the coupling member 150 inclines by the weight is the inclination angle of the coupling member 150 when the user holds a gripper T (FIG. 3) and carries the cartridge 2. More particularly, it is the inclination angle until the coupling member 150 is guided by the main assembly guide 130R1. In this case, the inclination angle of the coupling member 150 is regulated by first arc part 170*a* (inclination regulating portion 170*g*).

The predetermined part of the first arc part 170*a* for regulating the inclination angle of the coupling member 150 which inclines by the weight, and the projection regulating portion 170*c* are opposed to each other interposing the center O.

The first arc part 170*a* is provided with a projection regulating portion 170*c* which projects in the axial direction from the first arc part. The regulating portion 170 has a second arc part 170*d* which has the radius the same as the first arc part 170*a*, and a flat surface portion 158*e* extended continuing with the second arc part toward the side which has the projection 170*a*. When the coupling member 150 receives the external force (second external force) from the main assembly 1, the coupling member 150 is guided by the external force to the projection 170*b* along the second arc part 158*d* and the flat surface portion 158. By this, the coupling member 150 takes the pre-engagement angular position. The external force (second external force) is the urging force applied to the coupling member 150 by the slider 131.

As has been described hereinbefore, before the mounting to the main assembly 1, the regulating portion 170 prevents the coupling member 150 from inclining in unnecessary directions. By this, the size with respect to the longitudinal direction of the main assembly 1 is reducible. When the cartridge 2 is mounted to the main assembly 1, the cartridge 2 can be smoothly mounted to the main assembly 1. Here, the unnecessary directions are the directions other than the pre-engagement angular position.

Here, the process cartridge 2 using the present embodiment has the following structures (i)-(iv).

i) an electrophotographic photosensitive drum 20 rotatable about an axis and having a photosensitive layer at its peripheral surface.

ii) process means (charging roller 12, developing roller 41, cleaning blade 52) actable on the drum 20.

iii) a coupling member 150 engageable with the rotational force applying portion to receive an external force (first external force) for rotating the drum 20, the coupling member 150 being capable of taking a rotational force transmitting angular position (first angular position) for transmitting the external force (first external force) for rotating the drum 20 to the drum 20, a pre-engagement angular position (second angular position) in which the coupling member is inclined away from the axis L1 of the drum 20 from the rotational force transmitting angular position (first angular position) and a disengaging angular position (third angular position) in which the coupling member is inclined away from the axis L1 of the drum 20 from the rotational force transmitting angular position (first angular position).

Here, the external force (first external force) is a rotational force which is received by the coupling member 150 from the driving shaft 100.

iv) a regulating portion 170 for regulating an inclination angle of the coupling member such that downward inclination (by the gravity) angle of the coupling member 150 is smaller than an inclination angle of the coupling member when the coupling member is at the pre-engagement angular position (second angular position).

The regulating portion 170 surrounds the coupling member 150 in a perpendicular direction perpendicular to the axis L1 of the drum 20, and the regulating portion is provided with a first arcuate portion 170*a* and a projected portion 170*b* projecting in the perpendicular direction continuing from the first arcuate portion 170*a*, and wherein the first arcuate portion 170*a* (inclination regulating portion 170*g*) regulates the downward inclination of the coupling member 150, and the projected portion 170*b* regulates the inclination angle of the coupling member in the pre-engagement angular position (second angular position).

With such structures, in the present embodiment, when the cartridge 2 is inserted into the main assembly 1, the cartridge 2 can be smoothly inserted into the main assembly 1, without the coupling member 150 interfering with the other structure in the main assembly 1. More particularly, the insertion to the main assembly 1 of the cartridge 2 is smooth.

The first arc part 170*a* is provided with the projection regulating portion 170*c* which projects in the axial direction from the first arc part 170*a*. The projection regulating portion 170*c* has the second arc part 170*d* which has the radius the same as the first arc part 170*a*, and the flat surface portion 170*e* extended toward the projection 170*b* continuing with the second arc part 170*d*. When the coupling member 150 receives a second external force different from the external force (first external force), the coupling member 150 is elastically urged by the second external force to move along the second arc part 170*d* and flat surface portion 170*e*. The coupling member 150 is guided to projection 170*a*. By this, the coupling member 150 takes the pre-engagement angular position (second angular position).

With such a structure, in the present embodiment, when the coupling member 150 engages with the driving shaft 100 the engagement is assuredly established between the coupling member 150 and the driving shaft 100. The coupling between the cartridge 2 and the main assembly 1 is smoothly establishable.

The coupling member 150 is provided with the driving shaft receiving surface (recess) 150*f* co-axial with the axis L2 of the coupling member 150. The recess has the expanded part which expands toward the free end thereof. With such a structure, the coupling member 150 can engage and disengage smoothly relative to the driving shaft 100. The coupling member 150 can stably receive the rotational force from the driving shaft 100.

The rotational force receiving portions 150*e* of the coupling member 150 is disposed at equal intervals along the rotational direction of the coupling member 150 at the free end side of the expanded part. The rotational force receiving portion 150*e* is on the phantom circle C which has the center O on the axis L2 (FIG. 9), interposing the center O. With such a structure, the coupling member 150 can receive the rotational force with proper balance from the driving shaft 100.

The expanded part has a conical shape. The conical shape has the apex thereof on the axis L2.

With such a structure, the exact positioning between the coupling member 150 and the driving shaft 100 is accomplished.

The coupling member 150 is provided to the end of the drum 20 substantially revolvably around the axis L1. More particularly, it is movable (pivotable) substantially in all directions relative to the axis L1.

With such a structure, the coupling member 150 is engageable and disengageable relative to the driving shaft 100 irrespective of the phase of the driving shaft 100.

Even when the axis L2 is somewhat deviated from the axis L3 of the driving shaft 100, the coupling member 150 can receive the rotational force smoothly.

The cartridge 2 has the guide portion (cartridge guides 140R1, 140R2, 140L1, 140L2) guided in the direction perpendicular to the axis L1 direction of the drum 20. By this, the cartridge 2 is mountable and demountable relative to the main assembly 1 in the direction substantially perpendicular to the axis L3 of the driving shaft 100.

Here, the photosensitive drum unit 21, as will be described hereinafter, is the structure except for the process means of the structure described above in ii).

Between the cartridge 2 and the apparatus main assembly 1, in order to mount and demount the cartridge 2 smoothly, small gaps are provided. More specifically, the small gaps are provided $ between the guide 140R1 and the guide 130R1 with respect to the longitudinal direction, between the guide 140R2 and the guide 130R2 with respect to the longitudinal direction, between the guide 140L1 and the guide 130L1 with respect to the longitudinal direction, and between the guide 140L2 and the guide 130L2 with respect to the longitudinal direction. Therefore, at the time of the mounting and demounting of the cartridge 2 relative to the apparatus main assembly 1, the whole cartridge 2 can slightly incline within the limits of the gaps. For this reason, the perpendicularity is not meant strictly. However, even in such a case, the present invention is accomplished with the effects thereof. Therefore, the term "perpendicular substantially" covers the case where the cartridge slightly inclines.

Figure 24:
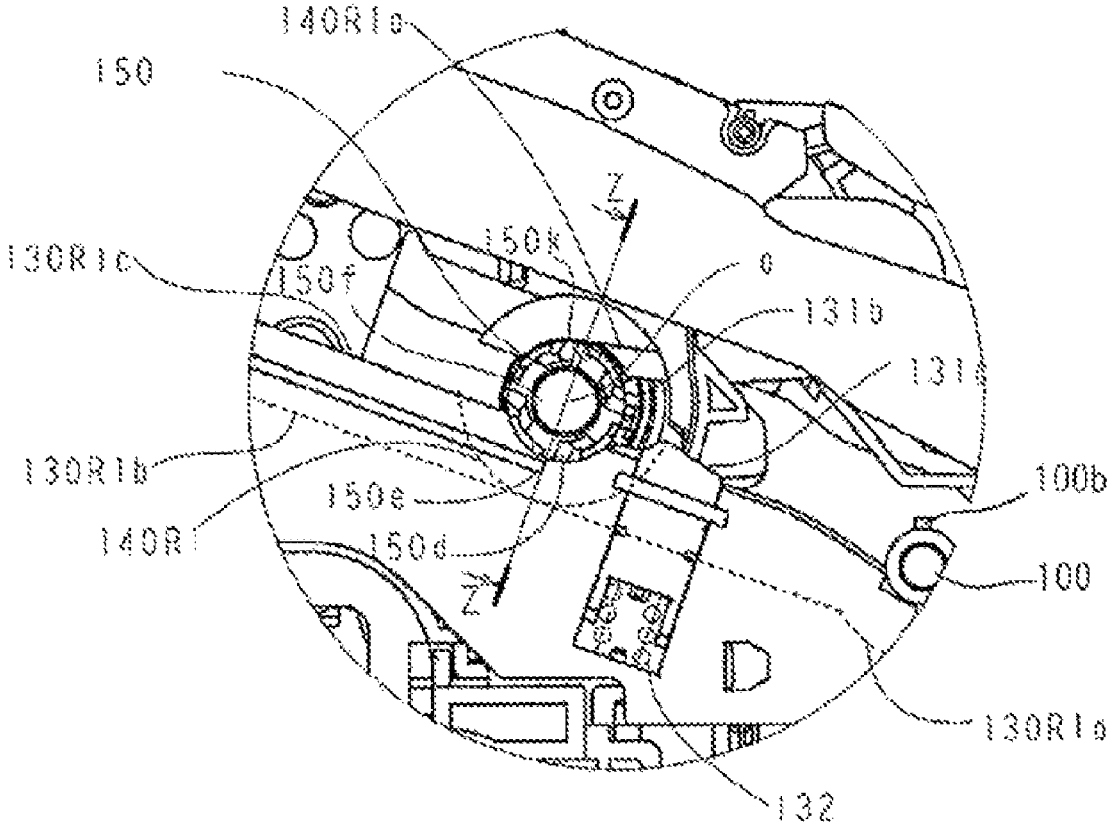
FIG. 24 is a side view illustrating a relation between the main assembly guide and the coupling member.

Standing-by portions 150*k* are provided between the projections 150*d*. The intervals between the adjacent projection 150*d* are larger than the outer diameter of pin 100*b* so that they can accept the rotational force transmitting pins (rotational force applying portion) 100*b* of the driving shaft 100 provided in the main assembly 1. The portions between the adjacent projections provide standing-by portions 150*k*. When the rotational force is transmitted from the driving shaft 100 to the coupling member 150, transmission pin 100*b* is positioned in any of standing-by portions 150*k* (FIG. 24).

Designated by 150*a* is a coupling side driven portion for receiving the rotational force from pin 100*b*. Designated by 150*b* is a coupling side driving portion for engaging with the rotational force transmitting portion 155 and for transmitting the rotational force to the drum shaft. Designated by 150*c* is the intermediate part 150*c* which connects driven portion 150*a* and driving portion 150*b* relative to each other (FIG. 32 (*a*)).

Figure 23:
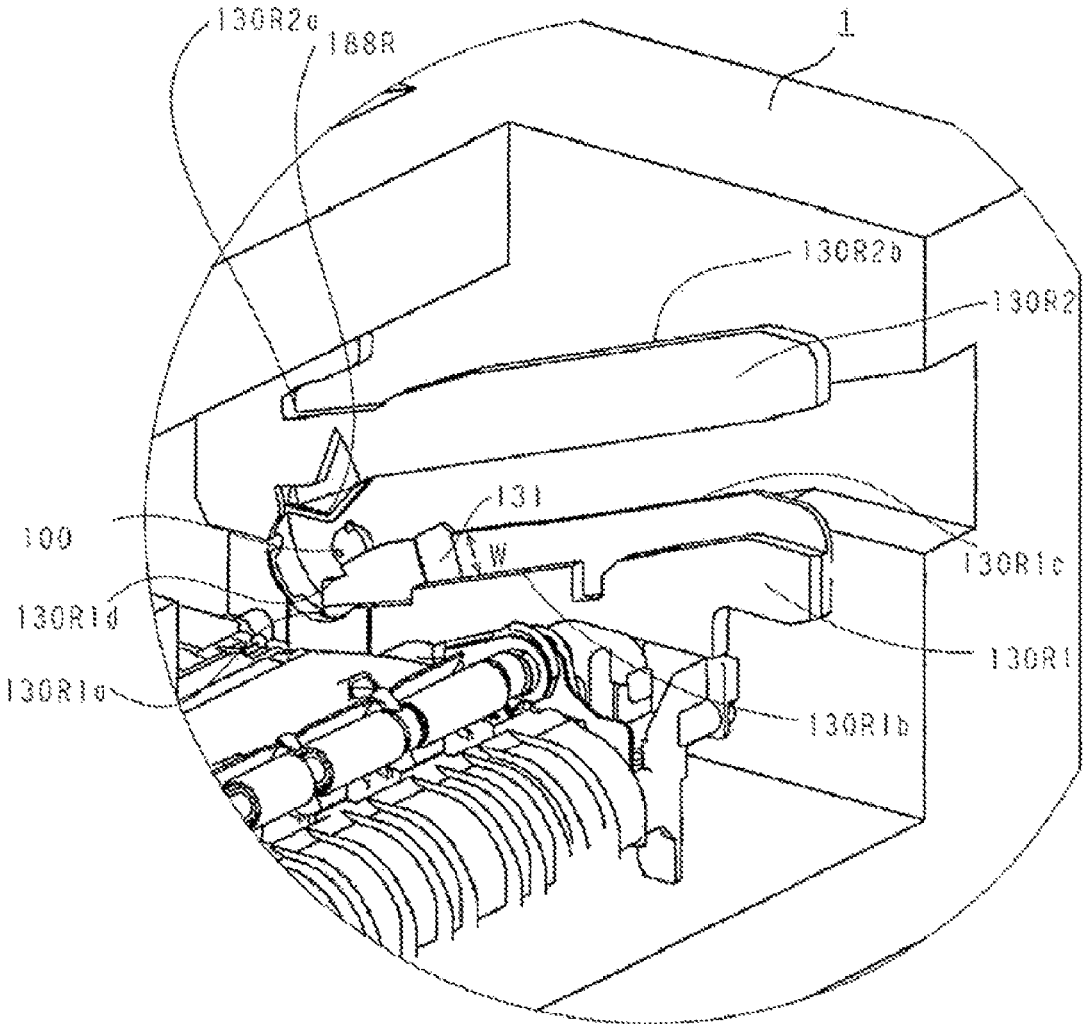
FIG. 23 is a perspective view illustrating a driving side of a main assembly guide.

Another means for inclining the axis L2 of the coupling member 150 relative to the drum axis L1 will be described. FIG. 23 is a perspective view illustrating the driving side of the main assembly 1. Referring to FIG. 23, the main assembly guide and the coupling urging means will be described. According to this embodiment, even if the frictional force is increased by rubbing of the intermediate part 150*c* or the main assembly guide, the coupling member 150 inclines assuredly to the pre-engagement angular position. The main assembly guide 130R1 has a guide surface 130R1*b* for guiding the cartridge 2 through the cartridge guide 140R1 (FIG. 3), a guide rib 130R1*c* for guiding the coupling member 150, and a cartridge positioning part 130R1*a*. The guide rib 130R1*c* is provided on the mounting locus of the cartridge 2. The guide rib 130R1*c* is extended to the front side of the driving shaft 100 with respect to the cartridge mounting direction. The rib 130R1*d* provided adjacent the driving shaft 100 has such a height as is free of interference when the coupling member 150 engages.

A part of rib 130R1*c* is cut away. The main assembly guide slider 131 is mounted on rib 130R1*c* slidably in the direction of arrow W. The slider 131 is pressed by the elastic force of the urging spring 132 (FIG. 24). In this state, the slider 131 projects beyond the guide rib 130R1*c*.

The slider 131 applies an urging force as the external force (second external force) to the coupling member 150. More particularly, the slider 131 applies the urging force to the coupling member 150 as the external force (second external force).

The main assembly guide 130R2 has a guide portion 130R2*b* and a cartridge positioning part 130R2*a* for guiding a part of drum frames 51, and determining the orientation at the time of the mounting of the cartridge 2.

Figure 25:
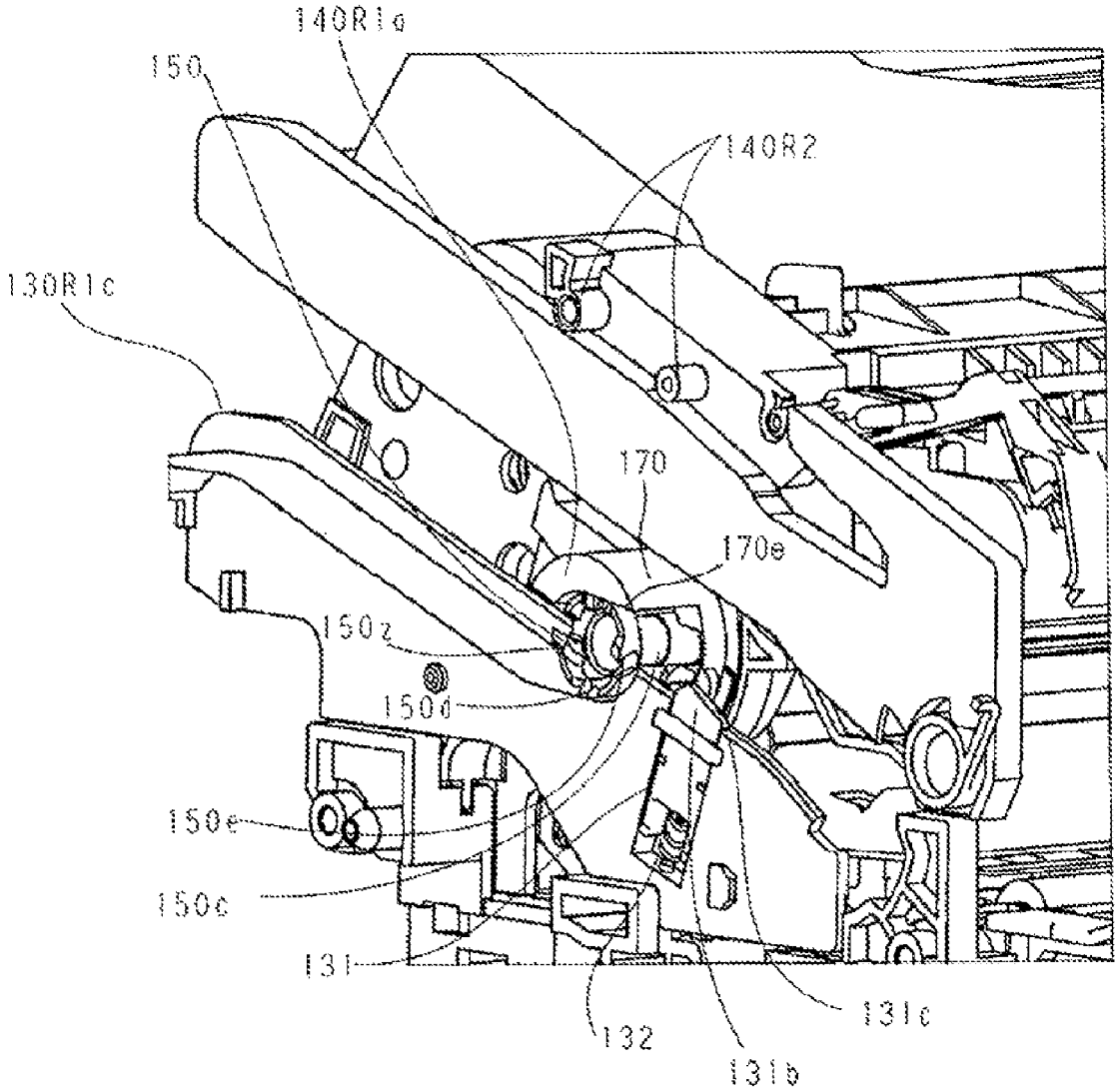
FIG. 25 is a perspective view illustrating a relation between the main assembly guide and the coupling.
Figure 26:
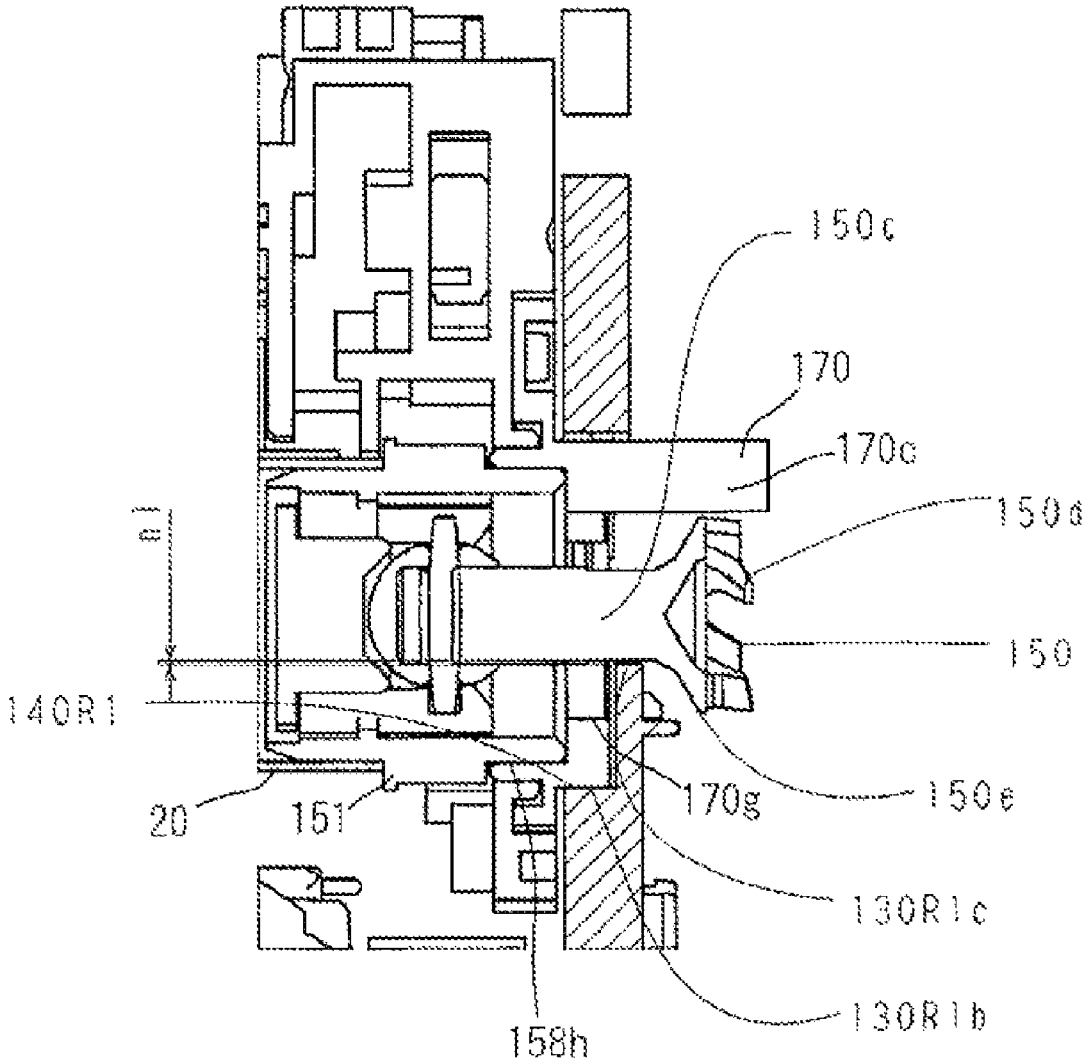
FIG. 26 is a side view illustrating a relation between the cartridge and the main assembly guide.

Referring to FIGS. 24-26, the relation among the main assembly guides 130R1, 130R2, the slider 131, and the cartridge 2 during the mounting operation of the cartridge 2 will be described. FIG. 24 is a side view as seen from the driving shaft 100 (FIG. 19) side of the main assembly, and FIG. 25 is a perspective view thereof. FIG. 25 is a Z-Z sectional view of FIG. 24.

In the driving side, the cartridge 2 moves in the state that the cartridge guide 140R1 contacts the guiding surface 130R1*b*. At this time, the intermediate part 150*c* is spaced by n1 from guide rib 130R1*c*. Therefore, a force is not applied to the coupling member 150. The coupling member 150 is regulated by regulating portion 140R1*a* over the upper surface and the left side. Therefore, the coupling member 150 can incline freely substantially only toward the mounting direction (X4).

Figure 27:
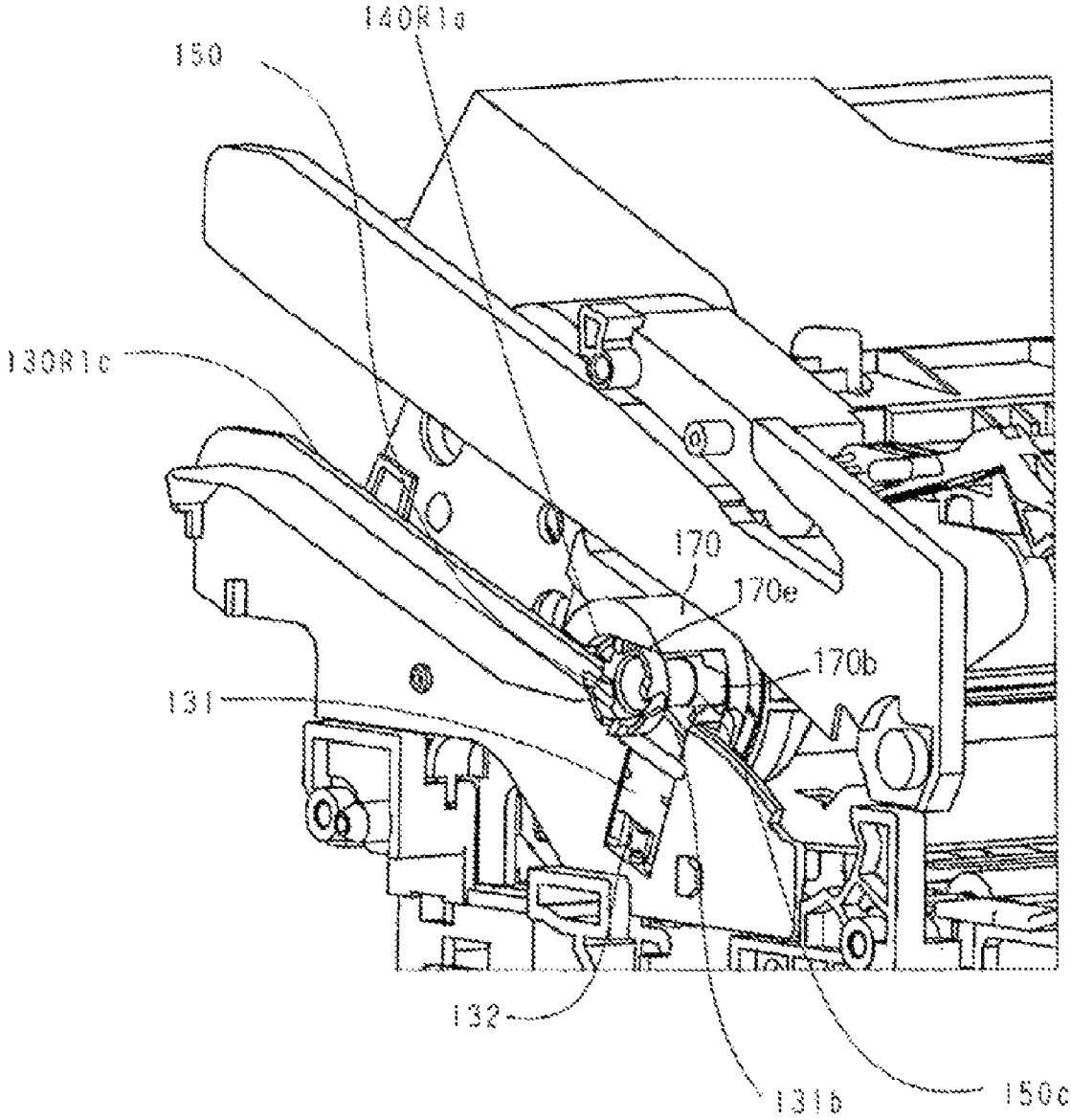
FIG. 27 is a perspective view illustrating a relation between the main assembly guide and the coupling.
Figure 28:
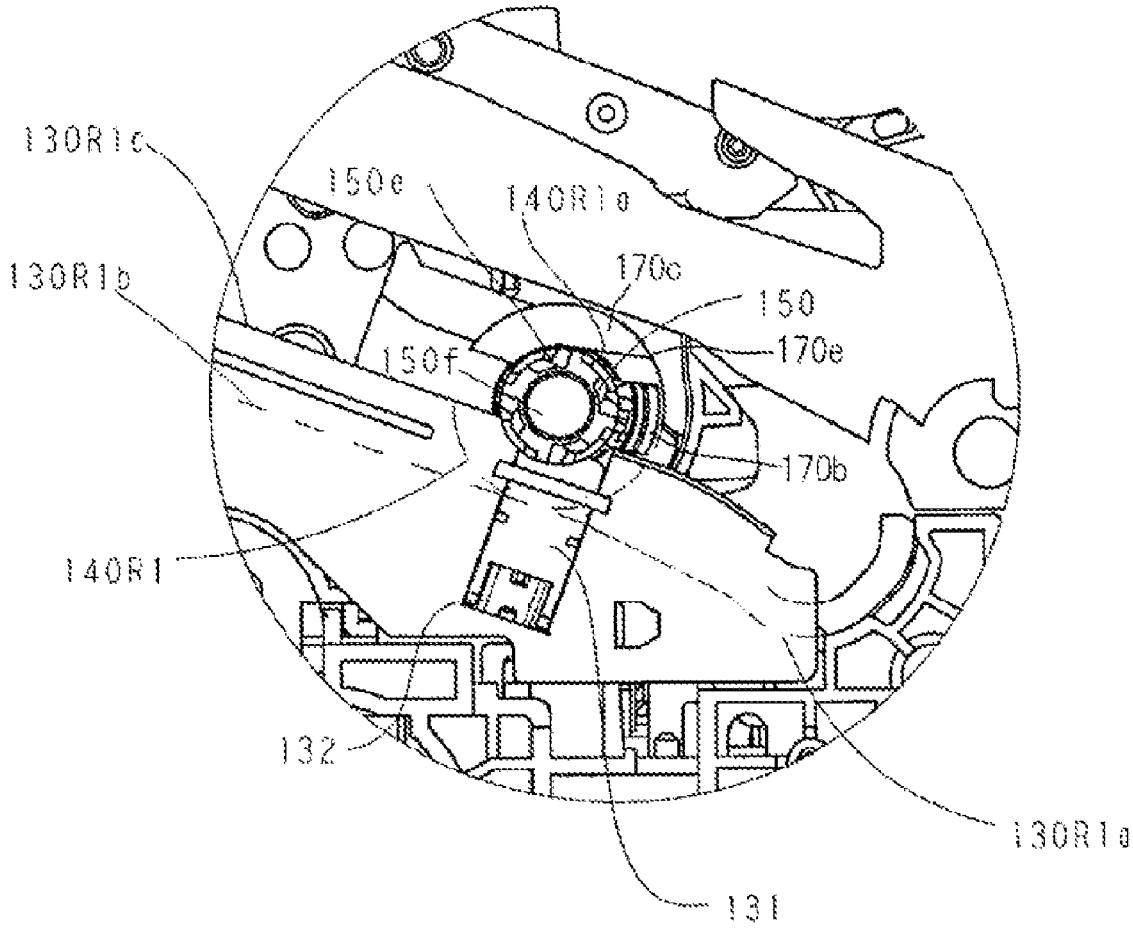
FIG. 28 is a side view illustrating a relation between the main assembly guide and the coupling.

Referring to FIGS. 27-30, movement of the slider 131 to the retracted position from the urging position in the contacted state of the coupling member 150 to the slider 131, will be described. FIG. 27-FIG. 28 show the state that the coupling member 150 contacts the apex 131*b* of the slider 131, that is, the state that the slider 131 has moved to the retracted position. By the entrance of the coupling member 150 pivotable only to the mounting direction (X4), the intermediate part 150*c*, and the inclined surface 131*a* of the projection of the slider 131 (FIG. 29) contact with each other. By this, the slider 131 is depressed to the retracted position.

Figure 30:
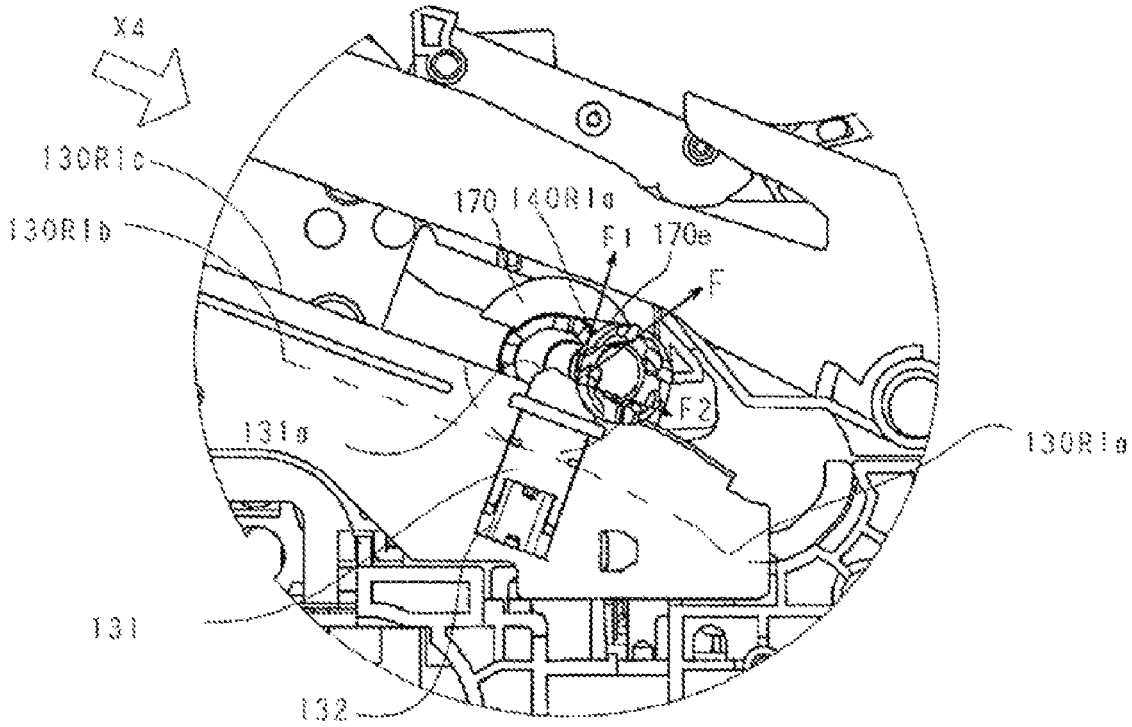
FIG. 30 is a side view illustrating a relation between the main assembly guide and the coupling.

Referring to FIGS. 29-30, the operation after the coupling member 150 rides over the apex 131*b* of the slider 131 will be described. FIGS. 29-30 show the state after the coupling member 150 rides over the apex 131*b* of the slider 131.

When the coupling member 150 rides over the apex 131*b*, the slider 131 tends to return from the retracted position to the urging position by the elastic force of the urging spring 132. In this case, a part of the intermediate part 150*c* of the coupling member 150 receives a force F from the inclined surface 131*c* of the slider 131. More particularly, the inclined surface 131*c* functions as a force applying portion, and a part of a intermediate part 150*c* functions as the force receiving portion 150*p*. The force receiving portion 150*p* is provided in the upstream side with respect to the cartridge mounting direction of intermediate part 150*c*. Therefore, the coupling member 150 can be inclined smoothly. The force F is divided into component forces F1 and F2. The upper surface of the coupling member 150 is confined by the regulating portion 140R1*a*. A part of regulating portion 140R1*a* is formed as a flat surface portion 158*e* ((a) of FIG. 22), and the flat surface portion 158*e* is substantially parallel with or slightly inclined relative to the mounting direction X4. Therefore, the coupling member 150 is inclined toward the mounting direction (X4) by the component force F2. In other words, the coupling member 150 inclines toward the pre-engagement angular position. By this, the coupling member 150 becomes engageable with the driving shaft 100.

As described above, the main assembly 1 is provided with a slider 131 which functions as the urging member which is movable between the urging position and the retracted positions retracted from the urging position and which is effective to apply the external force. When the cartridge 2 is mounted to the main assembly 1, the slider 131 contacts the entering cartridge 2, is once retracted from the urging position to the retracted position, and thereafter, returns to the urging position. The coupling member 150 is urged by the elastic force of the slider 131. By this, it is moved along the second arc part 158*d* and flat surface portion 158*e*, and is guided to the projection, so that the coupling member 150 takes the pre-engagement angular position.

the coupling member 150 has a rotational force receiving portion 150*e* and a rotational force transmitting portion 155 for transmitting a rotational force to the drum 20, and has an intermediate part (connecting portion) 150*c* of a cylindrical shape between rotational force receiving portion 150*e* and the rotational force transmitting portion 155. When the cartridge 2 is moved in the direction substantially perpendicular to the driving shaft 100, the intermediate part 150*c* contacts the fixed portion (main assembly guide 130R1) provided in the main assembly to take the pre-engagement angular position.

The driving shaft 100 transmits a rotational force as the external force (first external force) to the coupling member 150. The driving shaft 100 applies the rotational force as the external force (first external force) to the coupling member 150.

In the foregoing embodiments, the intermediate part 150*c* receives the force to incline the coupling member 150. However, the present invention is not limited to this example. For example, a portion other than the intermediate part 150*c* may contact with the slider 131, if it is pivotable when the coupling member 150 receives the force from the slider 131 of the main assembly 1, (Operation of the Coupling Member)

Figure 31:
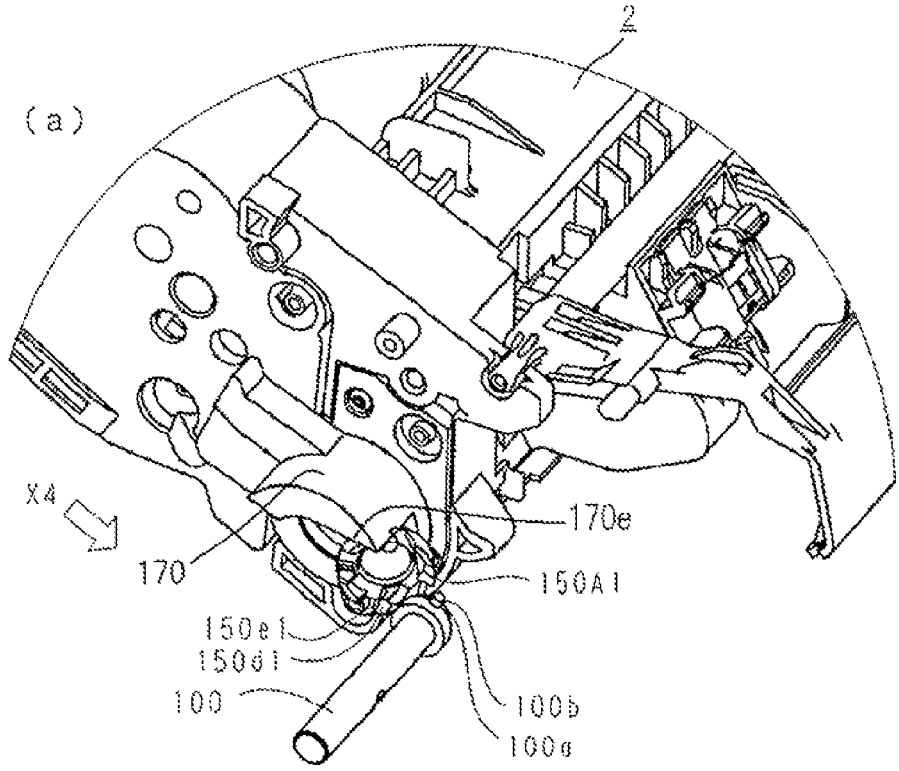
FIG. 31 is a perspective view illustrating a process of engagement between the driving shaft and the coupling member.
Figure 31:
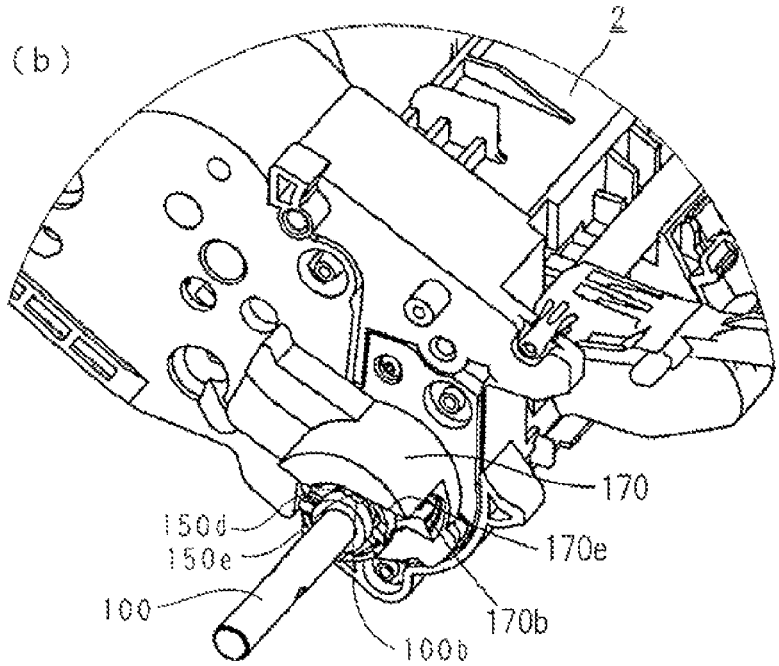
Figure 32:
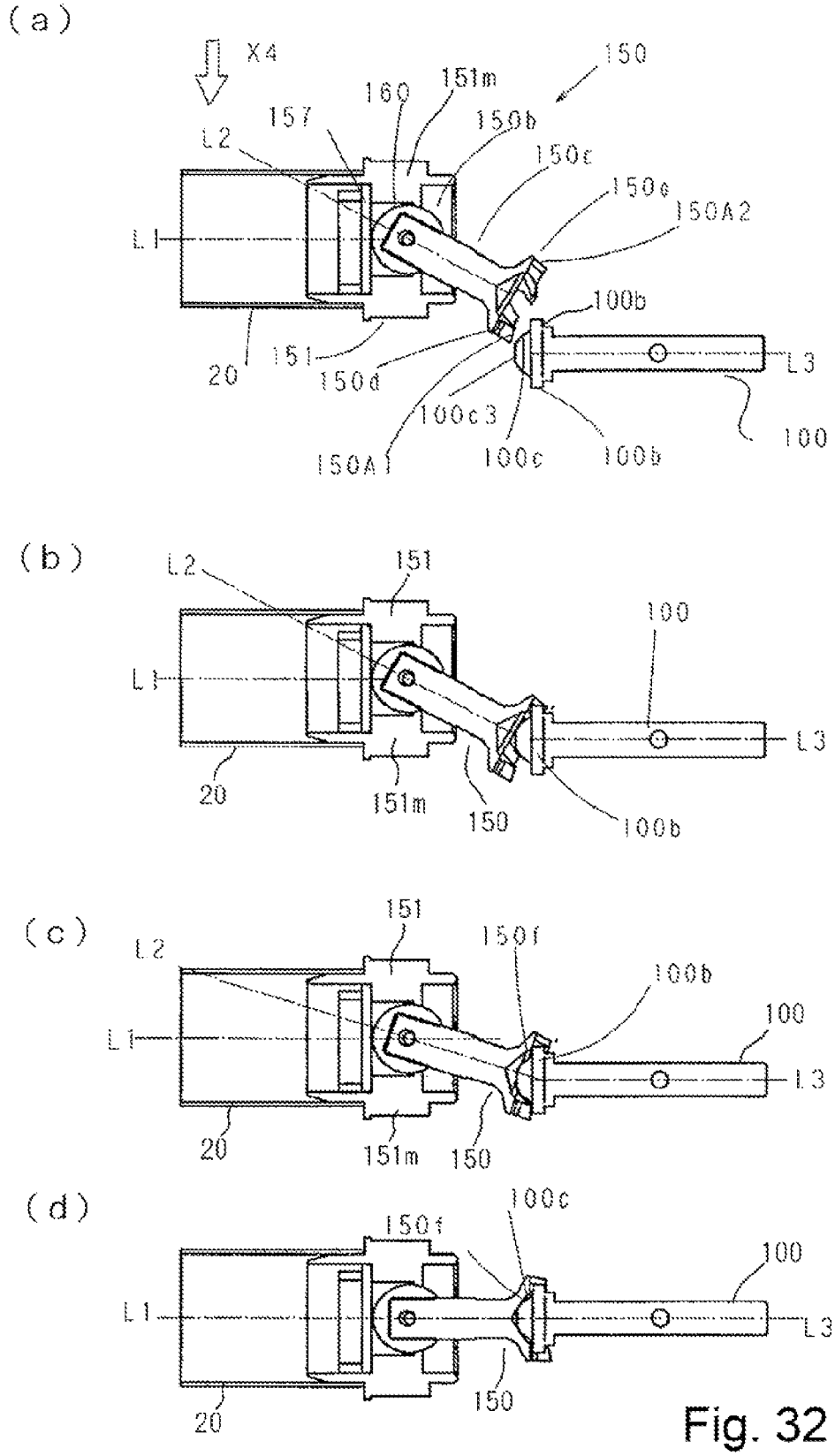
FIG. 32 is a perspective view illustrating a process of the coupling caught by the driving shaft.

The coupling engaging operation and the drive transmission will be described. The coupling member 150 and the driving shaft 100 engage with each other immediately before or simultaneously when the coupling 2 is set to the predetermined position or immediately before the cartridge 2 is positioned to the predetermined position of the main assembly 1. The engaging operation of this the coupling member 150 will be described referring to FIG. 31 and FIG. 32. FIG. 31 is a perspective view illustrating the major parts of the driving shaft 100 and the driving side of the cartridge 2. FIG. 32 is a longitudinal sectional view, as seen from the bottom of the main assembly.

EMBODIMENT

As shown in FIG. 32, in the mounting process of the cartridge 2, the cartridge 2 is mounted to the main assembly 1 in a direction (direction indicated by the arrow X4) substantially perpendicular to an axis L3 of a driving shaft 100. As for the coupling member 150, the axis L2 thereof inclines toward the downstream side with respect to the mounting direction relative to the drum axis L1 beforehand as the pre-engagement angular position ((a) of FIG. 31, (a) of FIG. 32). By this inclination of the coupling member 150, the free end position 150A1 is nearer to the drum axial direction L1 than the free end 100*c*3 of a driving shaft to the body of the drum 20 with respect. In addition, the free end position 150A2 is nearer to the pin 100*b* than the free end 100*c*3 of the driving shaft (FIG. 32 (*a*)).

First, the free end position 150A1 passes by the free end 100*c*3 of the driving shaft. Thereafter, the conical driving shaft receiving surface 150*f* or the driven projection 150*d* contacts to the free end portion 180*b* of the driving shaft 100, or the rotational force drive transmission pin 100*b*. Here, the driving shaft receiving surface 150*f* and/or the projection 150*d* is the cartridge side contact portion. In addition, the free end portion 100*c*3 and/or the pin 100*b* is the main assembly side engaging portion. In response to the movement of the cartridge 2, the coupling member 150 inclines (FIG. 32 (*c*)) so that the axis L2 substantially co-axial with the axis L1. Finally, when the position of the cartridge 2 is determined relative to the main assembly 1, the driving shaft 100 and the drum 20 are substantially co-axial with each other. More particularly, in the state that this cartridge side contact portion of the coupling member 150 is in contact with the main assembly side engaging portion, the cartridge 2 is inserted into the main assembly 1. By this insertion, the coupling member 150 is pivoted to the rotational force transmitting angular position from the pre-engagement angular position so that the axis L2 substantially co-axial with the axis L1. In this manner, the coupling member 150 and the driving shaft 100 are engaged with each other (FIG. 31 (*b*), FIG. 32 (*d*)).

More particularly, in the state that the coupling member 150 is at the rotational force transmitting angular position, the rotation axis L2 of the coupling member 150 is substantially co-axial with the axis L1 of the drum 20. In addition, in the state that the coupling member 150 is in the pre-engagement angular position, it inclines relative to the axis L1 of the drum 20 so that the downstream side in the mounting direction for mounting the cartridge 2 to the main assembly 1 can pass by the free end of the driving shaft 100.

As described above, at the time of mounting the cartridge 2 to the main assembly 1, while moving it in the direction perpendicular to the axis L1 of the drum 20, the coupling member 150 moves to the rotational force transmitting angular position from the pre-engagement angular position. By this, the coupling member 150 is opposed to the driving shaft 100.

More particularly, the coupling member 150 has the driving shaft receiving surface 150*f* on the rotation axis. When mounting the cartridge 2 to the main assembly 1, the cartridge 2 is moved in the direction substantially perpendicular to the axis L1 of the drum 20. In response to this movement, the coupling member 150 pivots to the rotational force transmitting angular position from the pre-engagement angular position so that a part of the coupling member positioned at the downstream side as seen in the direction of mounting the cartridge 2 to the main assembly 1 is permitted to circumvent the driving shaft 100. And, in the state that the coupling member 150 is in the rotational force transmitting angular position, the driving shaft receiving surface 150*f* covers the free end of the driving shaft 100. In this state, the rotational force receiving portion 150*e* of the coupling member 150 engages with the rotational force applying portion 100*b* which projects in the direction substantially perpendicular to the axis L3 of the driving shaft 100 in the free end portion of the driving shaft 100 in the rotational direction of the coupling member 150. By this, the coupling member 150 receives the rotational force from the driving shaft 100 to rotate.

As has been described hereinbefore, the coupling member 150 is mounted for inclining motion relative to the axis L1. And, in response to the mounting operation of the cartridge 2, by the pivoting of the coupling member 150, it can be engaged with the driving shaft 100.

Similarly to embodiment 1, the engaging operation of the coupling member 150 described above is possible regardless of the phases of the driving shaft 100 and the coupling member 150.

In this manner, in this embodiment, the coupling member 150 is mounted to the end of the drum substantially revolvably and swingably about the axis L1. The motion of the coupling shown in FIG. 32 may include the revolution.

In this embodiment, the revolution of the coupling member 150 is not a rotation of the coupling per se around the axis of the coupling L2 but the rotation of the inclined axis L2 around the axis of the drum 20 L1. However, within the limits of the play or the gap provided positively, the rotation of the coupling per se around the axis L2 is not excluded.

The coupling member is provided to an end of the electrophotographic photosensitive drum 20 and is capable of tilting relative to the axis L1 of the electrophotographic photosensitive drum 20 substantially in all directions. By doing so, the coupling member 150 can pivot smoothly between the pre-engagement angular position and the rotational force transmitting angular position and between the rotational force transmitting angular position and the disengaging angular position.

Substantially all directions is intended to mean that coupling can pivot to the rotational force transmitting angular position irrespective of the phase at which the rotating force applying portion stops.

In addition, the coupling can pivot to the disengaging angular position irrespective of the phase at which the rotating force applying portion stops.

A gap is provided between the pin 155 (rotating force transmitting portion) and the rotating force receiving member (FIG. 13) 155*h* so that the coupling member is capable of tilting relative to the axis L1 of the electrophotographic photosensitive drum 20 substantially in all directions. The coupling member 150 is provided at an end of the electrophotographic photosensitive drum 20. The coupling is mounted to the end of the drum in this manner. The coupling is capable of inclination substantially in all directions relative to the axis L1.

Figure 33:
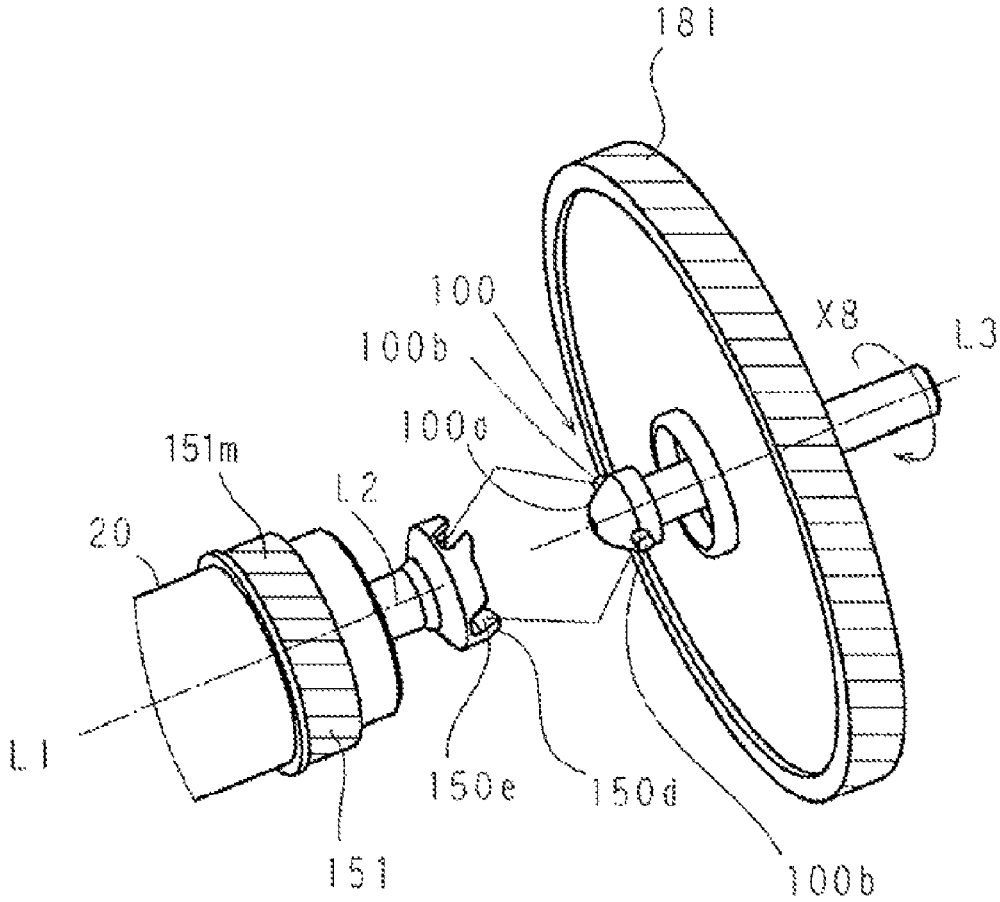
FIG. 33 is exploded perspective views of a driving shaft, a driving gear, a coupling and a drum shaft.

Referring to FIG. 33, the description will be made about the rotational force transmitting operation at the time of rotating the drum 20. The driving shaft 100 rotates with the drum driving gear 181 in the direction of X8 in the Figure by the rotational force received from the motor (unshown). The gear 181 is the helical gear and the diameter thereof in the present embodiment is approx. 80 mm. The pin 100*b* integral with the driving shaft 100 contacts to any two of the four receiving surfaces 150*e* (rotational force receiving portions) of the coupling member 150. The coupling member 150 rotates by the pin 100*b* pushing the receiving surfaces 150*e*. In addition, the rotational force transmitting pin 155 (in FIG. 11, the coupling side engaging portion, the rotational force transmitting portion) contacts the coupling member 150 to the rotational force transmitting surface (in FIG. 13, rotational force receiving portion) 151*h* (151*h*1, 151*h*2). By this, the coupling member 150 is coupled with the drum 20 so that the rotational force can be transmitted. Therefore, the drum 20 rotates through the flange 151 by the rotation of the coupling member 150.

In addition, in the case where the axis L1 and the axis L2 are somewhat deviated from concentric state, the coupling member 150 inclines to a slight degree. By this, the coupling member 150 can rotate without applying the large load to the drum 20 and the driving shaft 100. For this reason, no highly precise adjustment is required in the assembly operations of the driving shaft 100 and the drum 20. Therefore, the cost is reduced.

Figure 34:
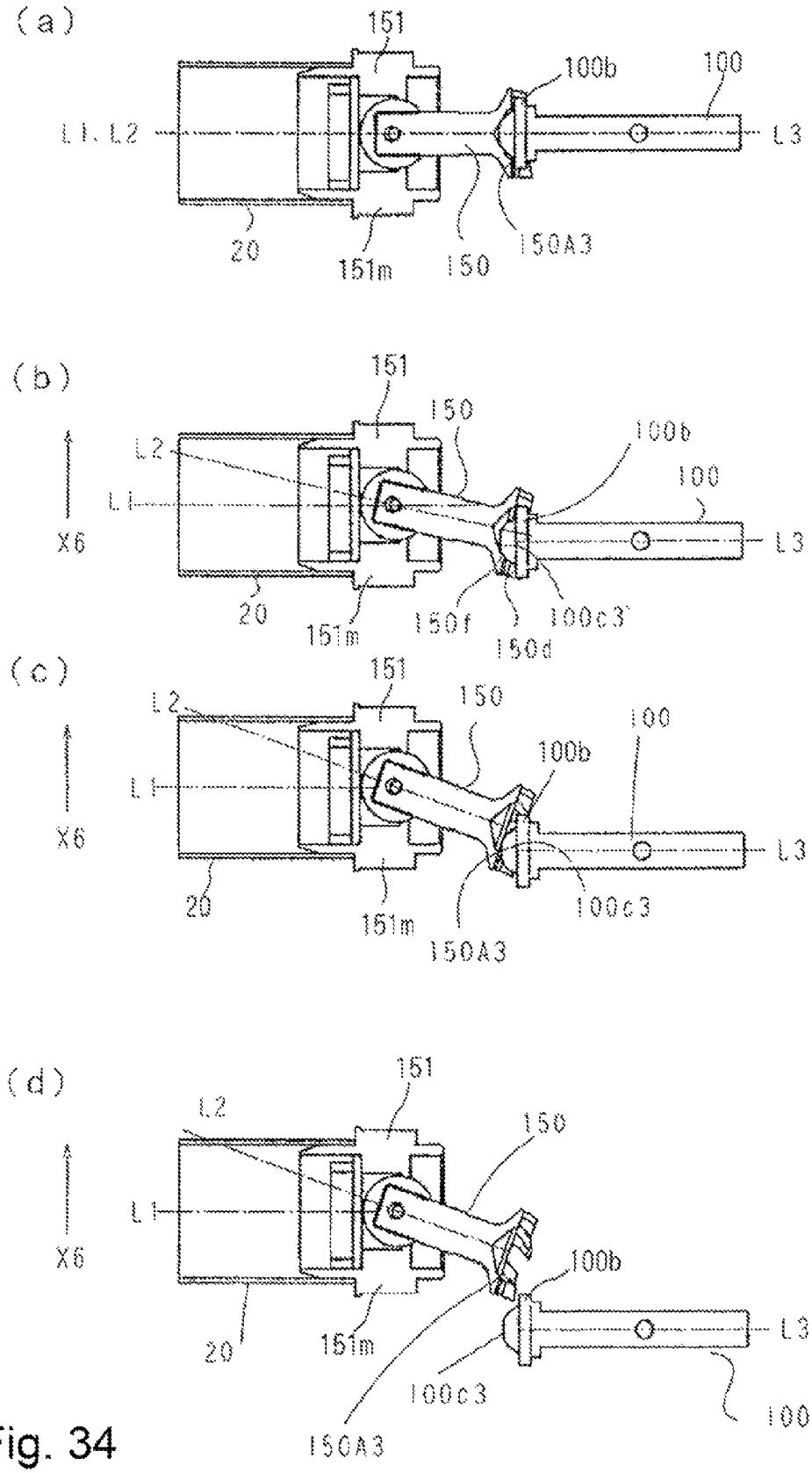
FIG. 34 is an illustration of a coupling operation in the process of taking the cartridge out of the main assembly of the apparatus.

The operation of the coupling member 150 at the time of taking the cartridge 2 out of the main assembly 1 will be described. FIG. 34 is a longitudinal sectional view, as seen from below the main assembly.

In (a) of FIG. 34, the axis L2 is substantially co-axial with the axis L1 as the rotational force transmitting angular position of the coupling member 150 in the state in which the drive of the drum 20 is at rest.

In (b) of FIG. 34, while the cartridge 2 moves to the front side (take-out direction X6) of the main assembly 1, the drum 20 moves to the front side. In response to this movement, the driving shaft receiving surface 150*f* or the projection 150*d* of the coupling member 150 contacts to the free end of the shaft of the driving shaft 100 100*c*3 at least, so that the axis L2 starts the inclination toward the upstream side of the take-out direction X6. This inclining direction is the same as the direction in which the coupling member 150 inclines at the time of the mounting of the cartridge 2.

In (c) of FIG. 34, when the cartridge 2 is further moved to the direction X6, the position of the upstream free end with respect to the direction X6 150 A3 inclines until it reaches the free end 100*c*3 of the shaft. The angle of the coupling member in this case 150 is the disengaging angular position which inclines in the direction away from the axis L1 of the drum 20 from the rotational force transmitting angular position.

In (d) of FIG. 34, in this state, while contacting to the free end 100*c*3 of the shaft, the coupling member 150 advances. Although the angle between the axis L1 and the axis L2 differs from the angle at the time of the mounting, the free end position 150 A3 which is a part of coupling member 150 circumvents the free end 100*c*3 of the shaft similarly to the case of the mounting.

In the state that the coupling member 150 is in the disengaging angular position, it inclines relative to the axis L1 of the drum 20 so that the upstream side thereof with respect to the removing direction of dismounting the cartridge 2 from the main assembly 1 can pass by the free end of the driving shaft 100. More particularly, when dismounting the cartridge 2 from the main assembly 1, the cartridge is moved in the direction substantially perpendicular to the axis of the drum 20 L1. In response to this movement, as seen in the direction opposite from the removing direction for dismounting the cartridge 2 from the main assembly 1, the coupling member 150 pivots to the disengaging angular position from the rotational force transmitting angular position so that a part of the coupling member positioned behind the driving shaft 100 is permitted to circumvent the driving shaft. Thus, by the coupling member 150 pivoting, the coupling member 150 disengages from the driving shaft 100.

Accordingly, in the case where the cartridge is taken out, it is also expressed as a part of coupling circumventing the driving shaft.

Thereafter, the cartridge 2 is taken out from the main assembly 1.

Figure 35:
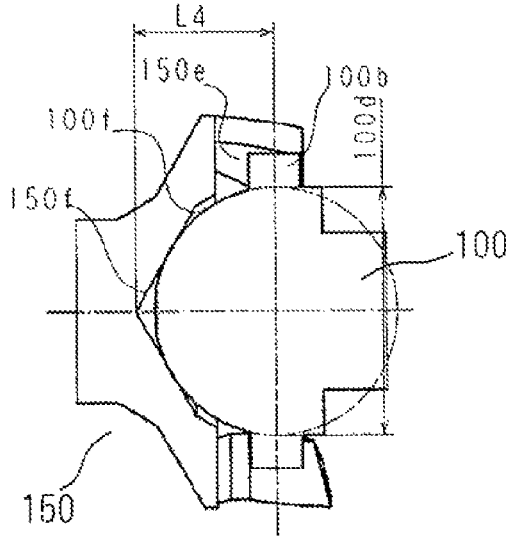
FIG. 35 is an illustration of an end configuration of the driving shaft.
Figure 35:
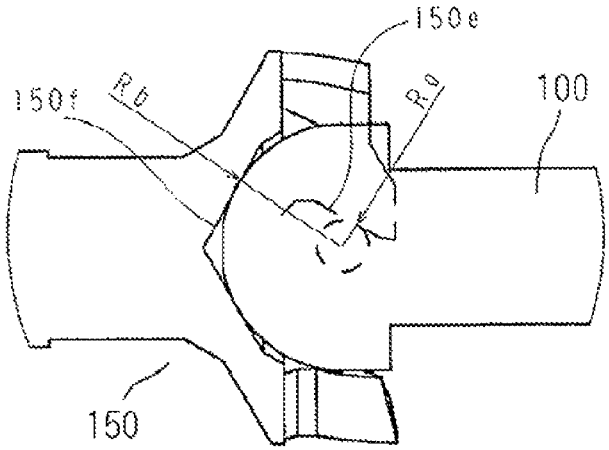
Figure 35:
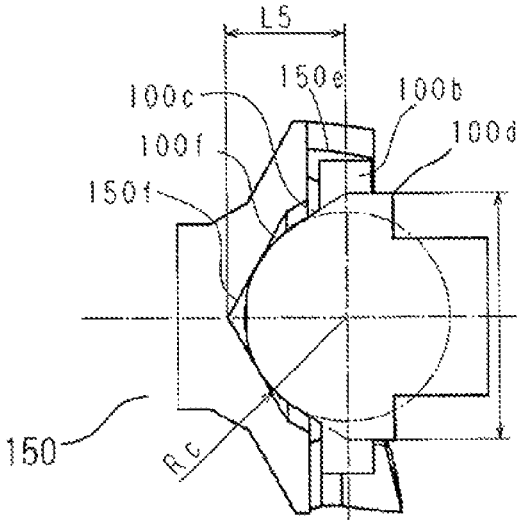

Referring to FIG. 35, the description will be made in more detail about the tip shape of the driving shaft 100. As an example of the simple configuration of the driving shaft 100, there is a combination of the semispherical surface 100*f* and the cylindrical surface 100*d* shown in (a) of FIG. 35. By the semispherical surface 100*f* abutting to the funnel-like driving shaft receiving surface (conic surface) 150*f* of the coupling member 150, the relative position between the driving shaft 100 and the coupling member 150 is determined. For this reason, it is desirable to position the center (center of the sphere) of the semispherical surface 100*f* on the centerline of the drive transmission pin 100*b*. As shown in (b) of FIG. 35, even if the coupling member 150 inclines during the rotation, a distance Ra between the rotational force receiving portion 150*e* and the drive transmission pin 100*b* does not change. In addition, a distance Rb between the driving shaft receiving surface 150*f* and the drive transmission pin 100*b* does not change, and therefore, the stabilized rotation can be continued.

The present embodiment employs the configuration in which the longitudinal size of the driving shaft 100 is reducible. The radius of the semispherical surface 100*f* which is the first positioning portion is small in the configuration shown in (b) of FIG. 34. As shown in the description, the center of the semispherical surface 100*f* is on the centerline of the drive transmission pin 100*b* which is rotational force applying portion. Correspondingly to the reduction of the radius semispherical shape, the drive transmission pin 100*b* approaches to the coupling member 150.

The portion between the semispherical surface 100*f* and the cylindrical surface 100*d* is a conic surface 100*g* as the guiding portion. As has been described with FIG. 32, by the time the coupling member 150 engages completely with the driving shaft 100, it inclines from the pre-engagement angular position to the rotational force transmitting angular position. In this embodiment, in order to carry out this operation smoothly, the conic surface 100*g* is formed without a step.

The diameter of the cylindrical surface 100*d* determines the amount of the play relative to the coupling member 150. Immediately after the cartridge 2 is mounted to the main assembly 1, the funnel-like driving shaft receiving surface (conic surface) 150*f* of the coupling member 150 and the semispherical surface of the driving shaft 100 100*f* may be separated from each other by the gap, with respect to the longitudinal direction, determined in consideration of dimensional tolerance and so on. At this time, the positioning function of the semispherical surface (first positioning portion) 100*f* does not work. In this embodiment, the play with respect to the radial direction between the cylindrical surface (second positioning portion) 100*d* and the coupling member 150 is small, so that the cylindrical surface 100*d* work(s) as the second positioning portion to position the coupling member 150 temporarily.

As has been described hereinbefore, the driving shaft 100 has the semispherical surface 100*f* (first positioning portion) and the cylindrical surface 100*d* (second positioning portion) which are the positioning portions relative to the coupling member 150. During the rotational force transmission, the coupling member 150 contacts with the semispherical surface 100*f*, and is spaced from the cylindrical surface 100*d*.

The semispherical surface 100*f* of the driving shaft 100 has the substantial spherical shape. The cylindrical surface 100*d* has the cylindrical shape.

In addition, the driving shaft 100 has the conic surface (guiding portion) 100*g* which connects between the semispherical surface 100*f* and the cylindrical surface 100*d*.

(1) A process cartridge 2 is detachably mountable to a main assembly 1 of an electrophotographic image forming apparatus. The image forming apparatus includes a driving shaft 100 having a rotational force applying portion 100*b* by moving in a direction substantially perpendicular to an axis of the driving shaft 100. The process cartridge 2 comprises:

i) an electrophotographic photosensitive drum 20 rotatable about an axis L1 and having a photosensitive layer at its peripheral surface.

ii) process means 12, 41, 52 actable on the electrophotographic photosensitive drum 20.

iii) a coupling member 150 is engageable with the rotational force applying portion 100*b* to receive a rotational force for rotating the electrophotographic photosensitive drum 20. The coupling member 150 is capable of taking a rotational force transmitting angular position for transmitting the rotational force for rotating the electrophotographic photosensitive drum 20 to the electrophotographic photosensitive drum 20, a pre-engagement angular position in which the coupling member 150 is inclined away from the axis L1 of the electrophotographic photosensitive drum 20 from the rotational force transmitting angular position and a disengaging angular position in which the coupling member 150 is inclined away from the axis of the electrophotographic photosensitive drum 20 from the rotational force transmitting angular position.

iv) a regulating portion 170 for regulating an inclination angle of the coupling member 150 such that downward inclination angle of the coupling member 150 is smaller than an inclination angle of the coupling member 150 when the coupling member 150 is at the pre-engagement angular position.

In mounting the process cartridge 2 to the main assembly 1 of the apparatus by moving the process cartridge 2 in a direction substantially perpendicular to the axis L1 of the electrophotographic photosensitive drum 20, the coupling member 150 moves from the pre-engagement angular position to the rotational force transmitting angular position to oppose the driving shaft 100, and in dismounting the process cartridge 2 from the main assembly 1 of the apparatus by moving the process cartridge 2 in a direction substantially perpendicular to the axis of the electrophotographic photosensitive drum 20, the coupling member 150 moves from the rotational force transmitting angular position to the disengaging angular position to disengage from the driving shaft 100. The disengagement is enabled by movement of the coupling member 150 to the disengagement angular position.

With such structures, the cartridge 2 can be mounted and dismounted relative to the main assembly 1 in a direction substantially perpendicular to the axis L3.

(2) The regulating portion 170 surrounds the coupling member 150 in a perpendicular direction perpendicular to the axis L1 of the electrophotographic photosensitive drum 20, and the regulating portion 170 is provided with a first arcuate portion 170*a* and a projected portion 170*b* projecting in the perpendicular direction continuing from the first arcuate portion 170*a*, and wherein the first arcuate portion 170*a* regulates the downward inclination (by the gravity) of the coupling member 150, and the projected portion 170*b* regulates the inclination angle of the coupling member 150 in the pre-engagement angular position.

(3) The first arcuate portion 170*a* is provided with a regulating projection 170*c* projecting in the axial direction from the first arcuate portion 170*a*. The regulating projection 170*c* is provided with a second arcuate portion 170*d* having the same radius of arc as that of the first arcuate portion 170*a*, and a flat surface portion 170*e* extending from the second arcuate portion 170*d* toward the projected portion 170*b*. When the coupling member 150 receives an external force from the main assembly 1 of the apparatus, the coupling member 150 is moved by the external force along the second arcuate portion 170*d* and the flat surface portion 170*e* to the projected portion 170*b*. By this, the coupling member 150 is positioned at the pre-engagement angular position.

With such structures, the inclination angle of the coupling member 150 due to the gravity can be regulated, and therefore, the cartridge 2 B can be smoothly mounted to the main assembly 1.

(4) The main assembly 1 of the apparatus includes a slider (urging member) 131, movable between an urging position and a retracted position retracted from the urging position, for applying the external force. The coupling member 150 is urged by an elastic force of the slider 131 which when the process cartridge 2 is mounted to the main assembly 1 of the apparatus, contacts the process cartridge 2 to retracts temporarily from the urging position to the retracted position and then restore to the urging position so as to move along the second arcuate portion 170*d* and the flat surface portion 170*e* to the projected portion 170*b*. By this, the coupling member 150 is positioned at the pre-engagement angular position.

With such a structure, the engagement between the coupling member 150 and the driving shaft 100 is assuredly established.

(5) The coupling member 150 has a recess (driving shaft receiving surface) 150*f* in which a rotational axis L2 of the coupling member 150 extends, wherein when the process cartridge 2 is mounted to the main assembly 1 of the electrophotographic image forming apparatus, the process cartridge 2 pivots from the pre-engagement angular position to the rotational force transmitting angular position so that downstream a part of the coupling member 150, with respect to the mounting direction in which the process cartridge 2 is mounted to the main assembly 1 of the electrophotographic image forming apparatus circumvents the driving shaft 100. The recess 150*f* is over a free end of the driving shaft 100 in the state in which the coupling member 150 is positioned at the rotational force transmitting angular position. The coupling member 150 is rotated by a rotational force through engagement, in a rotational direction of the coupling member 150, to the rotational force applying portion 100*b* which is projected in a direction substantially perpendicular to an axis L3 of the driving shaft 100 adjacent to the free end of the driving shaft 100. When the process cartridge 2 is dismounted from the main assembly 1 of the electrophotographic image forming apparatus, the coupling member 150 is disengaged from the driving shaft 100 by moving (pivoting) from the rotational force transmitting angular position to the disengaging angular position so that part of the coupling member 150 circumvents the driving shaft 100 in response to movement of the process cartridge 2 in the direction substantially perpendicular to the axis L1 of the electrophotographic photosensitive drum 20. By this, the coupling member disengages from the driving shaft 100.

(6) A plurality of such rotational force receiving portions 150*e* are provided on a phantom circle C having a center on the rotational axis L2 of the coupling member 150 at positions substantially diametrically opposite to each other.

(7) The recess includes an expanding portion expanding toward a free end thereof. A plurality of the rotational force receiving portions 150*e* are provided at regular intervals along a rotational direction of the coupling member 150. The rotational force applying portion 100*b* is provided at each of two positions which are diametrically opposite to each other with respect to the axis L3 of the driving shaft 100. The coupling member 150 receives a rotational force from the driving shaft 100 to rotate by one of the rotational force receiving portions 150*e* engaging to one of the rotational force applying portion 100*b* and by the other of rotational force receiving portions 150*e* engaging to the other of the rotational force applying portions 100*b*. One of the rotational force receiving portions 150*e* is opposed to the other of the rotational force receiving portions 150*e*, and one of the rotational force applying portions 100*b* is opposed to the other of the rotational force applying portions 100*b*.

With such structure, the coupling can rotate smoothly.

(8) The expanding portion has a conical shape having an apex "a" (center O) on the rotational axis of the coupling member 150. In the state in which coupling member 150 is positioned at the rotational force transmitting angular position, the apex is opposed to the free end of the driving shaft 100, and the coupling member 150 is over the free end of the driving shaft 100 when the rotational force is transmitted to the coupling member 150. The rotational force receiving portions 150*e* are provided at regular intervals in a rotational direction of the coupling member 150.

(9) In the state in which coupling member 150 is positioned at the rotational force transmitting angular position, the rotational axis L2 of the coupling member 150 is substantially coaxial with the axis L1 of the electrophotographic photosensitive drum 20, wherein in the state in which coupling member 150 is positioned at the pre-engagement angular position, the coupling member 150 is inclined relative to the axis L1 of the electrophotographic photosensitive drum 20 so that downstream a part thereof with respect to the mounting direction in which the process cartridge 2 is mounted to the main assembly 1 of the apparatus passes by the free end of the driving shaft, wherein in the state in which coupling member 150 is positioned at the disengaging angular position, the rotational axis L2 of the coupling member 150 is inclined relative to the axis L1 of the electrophotographic photosensitive drum 20 so as to permit an upstream portion of the coupling member 150 passes by the free end of the driving shaft 100 in a removing direction in which the process cartridge 2 is dismounted from the main assembly 1 of the electrophotographic image forming apparatus.

(10) The coupling member 150 is provided to an end of the electrophotographic photosensitive drum 20 and is capable of revolvable relative to the axis L1 of the electrophotographic photosensitive drum 20 substantially in all directions.

With such structures, the coupling member 150 is capable of engaging and disengaging relative to the driving shaft 100 irrespective of the phase of the driving shaft 100.

(11) A gap is provided between the rotating force transmitting portion 155 and the rotating force receiving member 151*h* so that coupling member 150 is capable of tilting relative to the axis L1 of the electrophotographic photosensitive drum 20 substantially in all directions. The rotating force transmitting portion 155 is provided at an end of the electrophotographic photosensitive drum 20 and is movable relative to the rotating force receiving member 151*h*. The rotating force transmitting portion 155 and the rotating force receiving member 151*h* are engageable to each other in a rotational direction of the coupling member 150.

(12) The coupling member 150 is provided with a rotating force transmitting portion 155 for transmitting the rotating force to be transmitted to the electrophotographic photosensitive drum 20, the rotating force transmitting portion 155 being arranged in line with the rotating force receiving portion in the rotational axis L2 direction of the coupling member 150, the coupling member 150 is further provided with an intermediary portion 150*c* between the rotating force receiving portion and the rotating force transmitting portion 155, and wherein when the process cartridge 2 is moved in the direction substantially perpendicular to the driving shaft 100, the intermediary portion 150*c* is contacted by a fixed portion (main assembly guide 130R1) of the main assembly 1 of the apparatus so that coupling member 150 takes the pre-engagement angular position.

With such structures, the coupling member 150 can assuredly engage with the coupling member 150.

The structures of the electrophotographic image forming apparatus according to the above-described embodiments are summarized as follows.

(13) The electrophotographic image forming apparatus includes a main assembly to which a process cartridge 2 is detachably mountable. The electrophotographic image forming apparatus comprises:

i) a driving shaft 100 having a rotating force applying portion 100*b*.

ii) a process cartridge 2 including.

an electrophotographic photosensitive drum 20 rotatable about an axis L1 and having a photosensitive layer at its peripheral surface, process means (12, 41, 52) actable on the electrophotographic photosensitive drum 20, a coupling member 150 engageable with the rotational force applying portion 100*b* to receive a rotational force for rotating the electrophotographic photosensitive drum 20, wherein the coupling member 150 is capable of taking a rotational force transmitting angular position for transmitting the rotational force for rotating the electrophotographic photosensitive drum 20 to the electrophotographic photosensitive drum 20, a pre-engagement angular position in which the coupling member 150 is inclined away from the axis L1 of the electrophotographic photosensitive drum 20 from the rotational force transmitting angular position and a disengaging angular position in which the coupling member 150 is inclined away from the axis L1 of the electrophotographic photosensitive drum 20 from the rotational force transmitting angular position, a regulating portion 170 for regulating an inclination angle of the coupling member 150 such that downward inclination angle of the coupling member 150 is smaller than an inclination angle of the coupling member 150 when the coupling member 150 is at the pre-engagement angular position, wherein in mounting the process cartridge 2 to the main assembly 1 of the apparatus by moving the process cartridge 2 in a direction substantially perpendicular to the axis L1 of the electrophotographic photosensitive drum 20, the coupling member 150 moves from the pre-engagement angular position to the rotational force transmitting angular position to oppose the driving shaft 100, and in dismounting the process cartridge 2 from the main assembly 1 of the apparatus by moving the process cartridge 2 in a direction substantially perpendicular to the axis of the electrophotographic photosensitive drum 20, the coupling member 150 moves from the rotational force transmitting angular position to the disengaging angular position to disengage from the driving shaft 100.

(14) The regulating portion 170 surrounds the coupling member 150 in a perpendicular direction perpendicular to the axis L1 of the electrophotographic photosensitive drum 20, and the regulating portion 170 is provided with a first arcuate portion 170*a* and a projected portion 170*b* projecting in the perpendicular direction continuing from the first arcuate portion 170*a*, and wherein the first arcuate portion 170*a* regulates the downward inclination (by the gravity) of the coupling member 150, and the projected portion 170*b* regulates the inclination angle of the coupling member 150 in the pre-engagement angular position.

(15) The first arcuate portion 170*a* is provided with a regulating projection 170*c* projecting in the axial direction from the first arcuate portion 170*a*. The regulating projection 170*c* is provided with a second arcuate portion 170*d* having the same radius of arc as that of the first arcuate portion 170*a*, and a flat surface portion 170*e* extending from the second arcuate portion 170*d* toward the projected portion 170*b*. When the coupling member 150 receives an external force from the main assembly 1 of the apparatus, the coupling member 150 is moved by the external force along the second arcuate portion 170*d* and the flat surface portion 170*e* to the projected portion 170*b*. By this, the coupling member 150 is positioned at the pre-engagement angular position.

With such structures, the inclination angle of the coupling member 150 due to the gravity can be regulated, and therefore, the cartridge 2 B can be smoothly mounted to the main assembly 1.

(16) The main assembly 1 of the apparatus includes a slider (urging member) 131, movable between an urging position and a retracted position retracted from the urging position, for applying the external force. The coupling member 150 is urged by an elastic force of the slider 131 which when the process cartridge 2 is mounted to the main assembly 1 of the apparatus, contacts the process cartridge 2 to retracts temporarily from the urging position to the retracted position and then restore to the urging position so as to move along the second arcuate portion 170*d* and the flat surface portion 170*e* to the projected portion 170*b*. By this, the coupling member 150 is positioned at the pre-engagement angular position.

(17) The coupling member 150 has a recess (driving shaft receiving surface) 150*f* in which a rotational axis L2 of the coupling member 150 extends, wherein when the process cartridge 2 is mounted to the main assembly 1 of the electrophotographic image forming apparatus, the process cartridge 2 pivots from the pre-engagement angular position to the rotational force transmitting angular position so that downstream a part of the coupling member 150, with respect to the mounting direction in which the process cartridge 2 is mounted to the main assembly 1 of the electrophotographic image forming apparatus circumvents the driving shaft 100. The recess 150*f* is over a free end of the driving shaft 100 in the state in which the coupling member 150 is positioned at the rotational force transmitting angular position. The coupling member 150 is rotated by a rotational force through engagement, in a rotational direction of the coupling member 150, to the rotational force applying portion 100*b* which is projected in a direction substantially perpendicular to an axis L3 of the driving shaft 100 adjacent to the free end of the driving shaft 100. When the process cartridge 2 is dismounted from the main assembly 1 of the electrophotographic image forming apparatus, the coupling member 150 is disengaged from the driving shaft 100 by moving (pivoting) from the rotational force transmitting angular position to the disengaging angular position so that part of the coupling member 150 circumvents the driving shaft 100 in response to movement of the process cartridge 2 in the direction substantially perpendicular to the axis L1 of the electrophotographic photosensitive drum 20. By this, the coupling member disengages from the driving shaft 100.

(18) In the state in which coupling member 150 is positioned at the rotational force transmitting angular position, the rotational axis L2 of the coupling member 150 is substantially coaxial with the axis L1 of the electrophotographic photosensitive drum 20, wherein in the state in which coupling member 150 is positioned at the pre-engagement angular position, the coupling member 150 is inclined relative to the axis L1 of the electrophotographic photosensitive drum 20 so that downstream a part thereof with respect to the mounting direction in which the process cartridge 2 is mounted to the main assembly 1 of the apparatus passes by the free end of the driving shaft, wherein in the state in which coupling member 150 is positioned at the disengaging angular position, the rotational axis L2 of the coupling member 150 is inclined relative to the axis L1 of the electrophotographic photosensitive drum 20 so as to permit an upstream portion of the coupling member 150 passes by the free end of the driving shaft 100 in a removing direction in which the process cartridge 2 is dismounted from the main assembly 1 of the electrophotographic image forming apparatus.

(19) The coupling member 150 is provided with a rotating force transmitting portion 155 for transmitting the rotating force to be transmitted to the electrophotographic photosensitive drum 20, the rotating force transmitting portion 155 being arranged in line with the rotating force receiving portion in the rotational axis L2 direction of the coupling member 150, the coupling member 150 is further provided with an intermediary portion 150*c* between the rotating force receiving portion and the rotating force transmitting portion 155, and wherein when the process cartridge 2 is moved in the direction substantially perpendicular to the driving shaft 100, the intermediary portion 150*c* is contacted by a fixed portion (main assembly guide 130R1) of the main assembly 1 of the apparatus so that coupling member 150 takes the pre-engagement angular position.

As shown in (d) of FIG. 34, in the rotational force transmitting angular position of the coupling member 150, the angle relative to the axis L1 of the coupling member 150 is such that in the state where the cartridge (B) is mounted to the apparatus main assembly (A), the coupling member 150 receives the transmission of the rotational force from the driving shaft 180, and it rotates. In the rotational force transmitting angular position of the coupling member 150, the rotational force for rotating the photosensitive drum is transmitted to the drum.

As shown in (d) of FIG. 34, in the pre-engagement angular position of the coupling member 150, the angular position relative to the axis L1 of the coupling member 150 is such that it is in the state immediately before the coupling member 150 engages with the driving shaft 100 in the mounting operation to the apparatus main assembly 1 of the cartridge 2. More particularly, it is the angular position relative to the axis L1 which the downstream free end portion 150A1 of the coupling 150 can pass by the driving shaft 100 with respect to the mounting direction of the cartridge 2.

As shown in (d) of FIG. 34, the disengaging angular position of the coupling member 150 is the angular position relative to the axis L1 of the coupling member 150 at the time of taking out the cartridge 2 from the apparatus main assembly 1, in the case that the coupling 150 disengages from the driving shaft 180. More particularly, as shown in (d) of FIG. 34, it is the angular position relative to the axis L1 with which the free end portion 150 A3 of the coupling 150 can pass by the driving shaft 180 with respect to the removing direction (X6) of the cartridge (B).

In the pre-engagement angular position or the disengaging angular position, the angle theta 2 which the axis L2 makes with the axis L1 is larger than the angle theta 1 which the axis L2 makes with the axis L1 in the rotational force transmitting angular position. As for the angle theta 1, 0 degree is preferable. However, in this embodiment, if the angle theta 1 is less than about 15 degrees, the smooth transmission of the rotational force is accomplished. This is also one of the effects of this embodiment. As for the angle theta 2, the range of about 20-60 degrees is preferable.

(20) The driving shaft 100 is provided with a first positioning portion 100*f* and a second positioning portion 100*d* relative to the coupling member 150. During rotating force transmission, the coupling member 150 contacts the first positioning portion, and is spaced from the second positioning portion.

The structures of the electrophotographic photosensitive drum according to the above-described embodiments are summarized as follows.

(21) The electrophotographic photosensitive drum unit 21 is detachably mountable to a main assembly 1 of an electrophotographic image forming apparatus. The main assembly includes a driving shaft 100 having a rotational force applying portion 100*b* by moving in a direction substantially perpendicular to an axis of the driving shaft 100, the drum unit 21 comprises:

i) an electrophotographic photosensitive drum 20 rotatable about an axis L1 and having a photosensitive layer at its peripheral surface.

ii) a coupling member 150 is engageable with the rotational force applying portion 100*b* to receive a rotational force for rotating the electrophotographic photosensitive drum 20. The coupling member 150 is capable of taking a rotational force transmitting angular position for transmitting the rotational force for rotating the electrophotographic photosensitive drum 20 to the electrophotographic photosensitive drum 20, a pre-engagement angular position in which the coupling member 150 is inclined away from the axis L1 of the electrophotographic photosensitive drum 20 from the rotational force transmitting angular position and a disengaging angular position in which the coupling member 150 is inclined away from the axis of the electrophotographic photosensitive drum 20 from the rotational force transmitting angular position.

iii) a regulating portion 170 for regulating an inclination angle of the coupling member 150 such that downward inclination angle of the coupling member 150 is smaller than an inclination angle of the coupling member 150 when the coupling member 150 is at the pre-engagement angular position.

In mounting the process cartridge 2 to the main assembly 1 of the apparatus by moving the process cartridge 2 in a direction substantially perpendicular to the axis L1 of the electrophotographic photosensitive drum 20, the coupling member 150 moves from the pre-engagement angular position to the rotational force transmitting angular position to oppose the driving shaft 100, and in dismounting the process cartridge 2 from the main assembly 1 of the apparatus by moving the process cartridge 2 in a direction substantially perpendicular to the axis of the electrophotographic photosensitive drum 20, the coupling member 150 moves from the rotational force transmitting angular position to the disengaging angular position to disengage from the driving shaft 100. The disengagement is enabled by movement of the coupling member 150 to the disengagement angular position.

(22) The regulating portion 170 surrounds the coupling member 150 in a perpendicular direction perpendicular to the axis L1 of the electrophotographic photosensitive drum 20, and the regulating portion 170 is provided with a first arcuate portion 170*a* and a projected portion 170*b* projecting in the perpendicular direction continuing from the first arcuate portion 170*a*, and wherein the first arcuate portion 170*a* regulates the downward inclination (by the gravity) of the coupling member 150, and the projected portion 170*b* regulates the inclination angle of the coupling member 150 in the pre-engagement angular position.

(23) The first arcuate portion 170*a* is provided with a regulating projection 170*c* projecting in the axial direction from the first arcuate portion 170*a*. The regulating projection 170*c* is provided with a second arcuate portion 170*d* having the same radius of arc as that of the first arcuate portion 170*a*, and a flat surface portion 170*e* extending from the second arcuate portion 170*d* toward the projected portion 170*b*. When the coupling member 150 receives an external force from the main assembly 1 of the apparatus, the coupling member 150 is moved by the external force along the second arcuate portion 170*d* and the flat surface portion 170*e* to the projected portion 170*b*. By this, the coupling member 150 is positioned at the pre-engagement angular position.

With such structures, the inclination angle of the coupling member 150 due to the gravity can be regulated, and therefore, the cartridge 2 can be smoothly mounted to the main assembly 1.

(24) The main assembly 1 of the apparatus includes a slider (urging member) 131, movable between an urging position and a retracted position retracted from the urging position, for applying the external force. The coupling member 150 is urged by an elastic force of the slider 131 which when the process cartridge 2 is mounted to the main assembly 1 of the apparatus, contacts the process cartridge 2 to retracts temporarily from the urging position to the retracted position and then restore to the urging position so as to move along the second arcuate portion 170*d* and the flat surface portion 170*e* to the projected portion 170*b*. By this, the coupling member 150 is positioned at the pre-engagement angular position.

(25) A plurality of such rotational force receiving portions 150*e* are provided on a phantom circle C having a center on the rotational axis L2 of the coupling member 150 at positions substantially diametrically opposite to each other.

(26) The coupling member 150 is provided with a recess including an expanding portion expanding toward a free end thereof. A plurality of the rotational force receiving portions 150*e* are provided at regular intervals along a rotational direction of the coupling member 150. The rotational force applying portion 100*b* is provided at each of two positions which are diametrically opposite to each other with respect to the axis L3 of the driving shaft 100. The coupling member 150 receives a rotational force from the driving shaft 100 to rotate by one of the rotational force receiving portions 150*e* engaging to one of the rotational force applying portion 100*b* and by the other of rotational force receiving portions 150*e* engaging to the other of the rotational force applying portions 100*b*. One of the rotational force receiving portions 150*e* is opposed to the other of the rotational force receiving portions 150*e*, and one of the rotational force applying portions 100*b* is opposed to the other of the rotational force applying portions 100*b*.

With such structure, the coupling can rotate smoothly and stably.

The expanding portion has a conical shape having an apex "a" (center O) on the rotational axis of the coupling member 150. In the state in which coupling member 150 is positioned at the rotational force transmitting angular position, the apex is opposed to the free end of the driving shaft 100, and the coupling member 150 is over the free end of the driving shaft 100 when the rotational force is transmitted to the coupling member 150. The rotational force receiving portions 150*e* are provided at regular intervals in a rotational direction of the coupling member 150.

With such a structure, the coupling member 150 can receive a smooth and stabilized rotating force.

According to the embodiments of the present invention, a process cartridge which is detachably mountable to a main assembly of an image forming apparatus having a driving shaft, in a direction substantially perpendicular to the axis of the driving shaft. Also, there are provided an electrophotographic photosensitive drum unit usable with such a process cartridge, and an electrophotographic image forming apparatus to which such a process cartridge is detachably mountable.

According to the embodiments of the present invention, the rotation accuracy of the electrophotographic photosensitive drum can be improved as compared with the case that engaging gears are used to transmit the rotational force from the main assembly to the process cartridge.

According to the embodiments of the present invention, before the process cartridge is mounted to the main assembly, the coupling member is prevented from inclining in an unnecessary direction to a great extend, and therefore, the process cartridge can be smoothly mounted to the main assembly. In addition, there are provided an electrophotographic photosensitive drum unit usable with such a process cartridge, and an electrophotographic image forming apparatus to which such a process cartridge is detachably mountable.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 161530/2008 filed Jun. 20, 2008, which is hereby incorporated by reference.

What is claimed is:

1. A process cartridge comprising:

i) a photosensitive drum rotatable about a drum axis thereof;

ii) a rotatable developing roller configured to develop a latent image formed on said photosensitive drum;

iii) a coupling member provided at an axial end portion of said photosensitive drum and rotatable about a coupling axis thereof so as to transmit a driving force to said photosensitive drum, said coupling member being capable of inclining relative to said photosensitive drum so that the coupling axis inclines relative to the drum axis; and iv) a regulating portion surrounding said coupling member to confine a range of the inclination of said coupling member, wherein said regulating portion is provided with a portion that opens in a direction away from said drum axis and away from said developing roller, and wherein an angle between the coupling axis and the drum axis is larger when at least a part of said coupling member is in said portion that opens than when said coupling member contacts another portion of said regulating portion.

2. A process cartridge according to claim 1, wherein said coupling member includes a connection end connected with said photosensitive drum, a free end, and a connecting portion connecting said connection end and said free end with each other, and wherein at least a part of said connecting portion is capable of being in said portion that opens in the direction away from said drum axis and away from said developing roller.

3. A process cartridge according to claim 2, wherein said connecting portion is in the form of a shaft extending along the coupling axis.

4. A process cartridge according to claim 2, wherein said regulating portion includes a guide portion that guides said coupling member into said portion that opens in the direction away from said drum axis and away from said developing roller when said coupling member receives an external force toward said guide portion at a side opposite said guide portion.

5. A process cartridge according to claim 4, wherein said guide portion extends outwardly along a direction of the drum axis of said photosensitive drum.

6. A process cartridge according to claim 4, wherein said guide portion guides said coupling member into said portion that opens in the direction away from said drum axis and away from said developing roller by contacting said free end of said coupling member.

* * * * *